US005893181A

United States Patent [19]

Moncaster

[11] Patent Number: 5,893,181

[45] Date of Patent: Apr. 13, 1999

[54] BATHING ENCLOSURE

[76] Inventor: Thomas R. Moncaster, 251 Cloydon Cir., Santa Barbara, Calif. 93108

[21] Appl. No.: 08/730,140

[22] Filed: Oct. 15, 1996

[51] Int. Cl.[6] ..... A47K 3/00

[52] U.S. Cl. ..... 4/557; 160/211

[58] Field of Search ..... 4/557, 607; 160/202, 160/210, 211

[56] References Cited

U.S. PATENT DOCUMENTS

| | | | |
|---|---|---|---|
| 139,232 | 5/1873 | Boughton | 160/211 |
| 865,404 | 9/1907 | Laurent | 160/211 |
| 903,695 | 11/1908 | Foster | 160/211 |
| 1,849,801 | 3/1932 | McGreger | 160/211 |
| 3,216,482 | 11/1965 | Lindholm | 160/216 |
| 4,635,699 | 1/1987 | Kauffman | 160/211 |
| 4,878,530 | 11/1989 | Jean | 160/211 |
| 4,897,889 | 2/1990 | Baus | 4/607 |
| 5,417,272 | 5/1995 | Marlowe et al. | 160/202 |

FOREIGN PATENT DOCUMENTS

| | | | |
|---|---|---|---|
| 0249830 | 12/1987 | European Pat. Off. | 4/607 |
| 0541877 | 5/1993 | European Pat. Off. | 4/607 |
| 2325032 | 12/1974 | Germany | 4/557 |
| WO9424917 | 10/1994 | WIPO | A47K 3/22 |

*Primary Examiner*—Charles E. Phillips
*Attorney, Agent, or Firm*—Leo F. Costello

[57] ABSTRACT

An enclosure for the entrance to a bathing facility, such as a bathtub/shower combination, or other area that can be completely closed, completely opened, or partially closed or opened. The preferred embodiment includes a column mounted in the plane of and at one side of the entrance; a dual cantilever extended from the column intermediate its upper and lower ends; and dual shower doors mounted on the cantilever so that a vertical plane containing the center of gravity of the doors intersects the column. The doors are mounted so that one of the doors is translationally movable for changing the degree of closure of the bathing facility and so that both doors can be pivoted out of the entrance to the facility to open it completely. The mounting of the doors, which features a bearing carriage in the dual cantilever, eliminates both a header and the typical tub rail, and allows the doors to be frameless. Moreover, the mounting enables the described translational and pivoting movement to be accomplished without sag or misalignment of the doors and thus without scraping or rubbing of the doors against each other or adjacent surfaces. Hinge assemblies providing useful adjustment features are included.

53 Claims, 10 Drawing Sheets

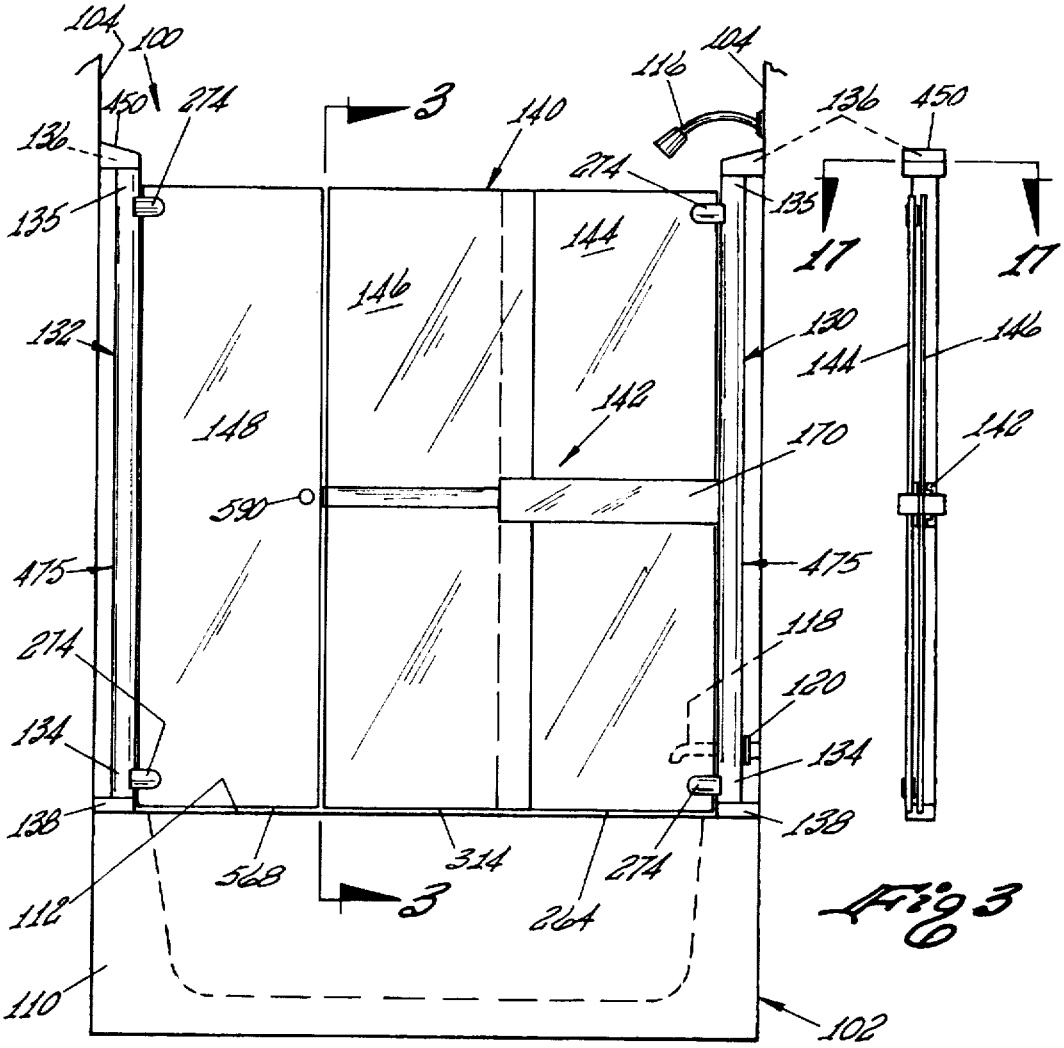
Fig 3
Fig 1
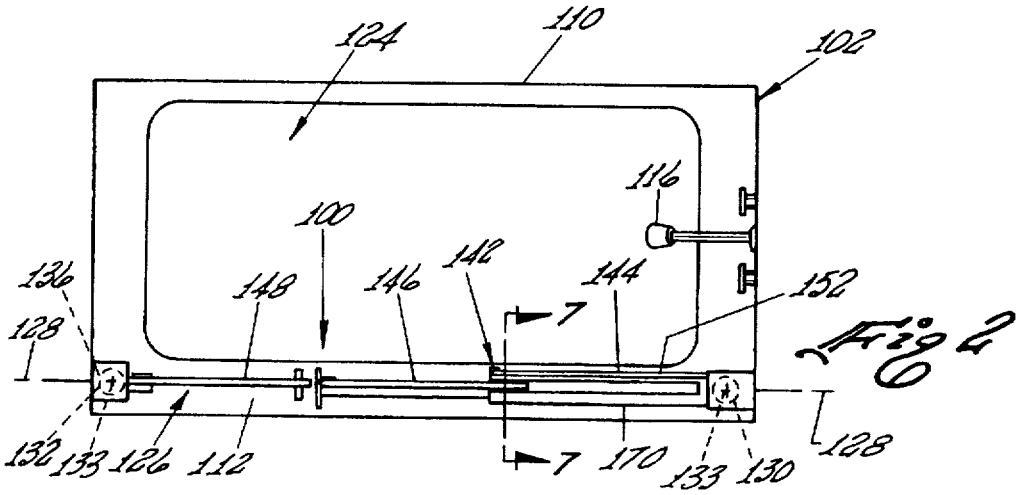
Fig 2

6/10

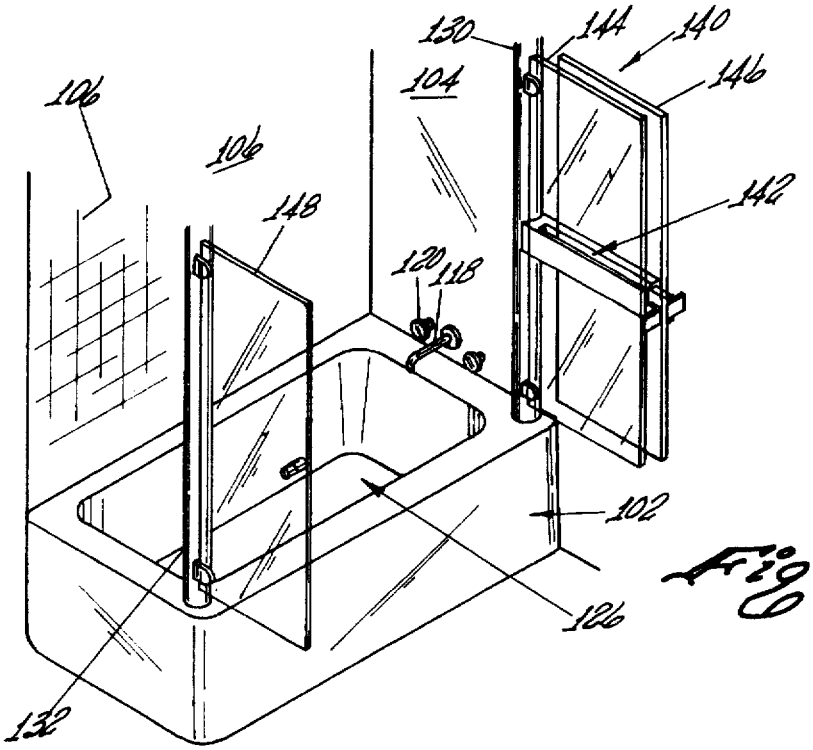
Fig 28
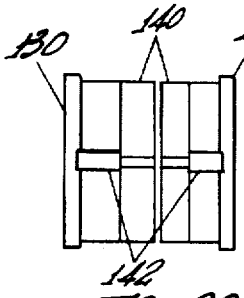
Fig 29
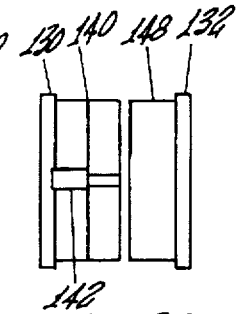
Fig 30
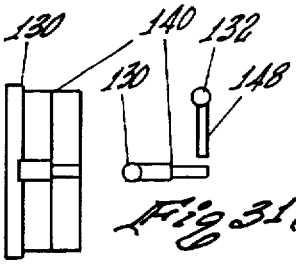
Fig 31(a)
Fig 31
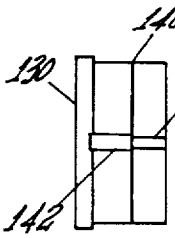
Fig 32
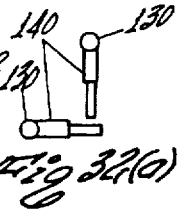
Fig 32(a)
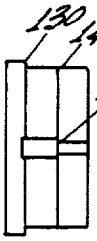
Fig 33
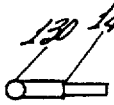
Fig 33(a)
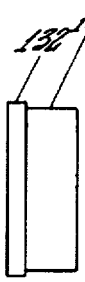
Fig 34
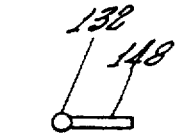
Fig 34(a)
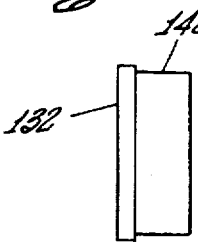
Fig 35
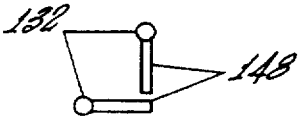
Fig 35(a)

BATHING ENCLOSURE

This application pertains to an enclosure for a bathing facility or other area and more particularly to the apparatus for supporting a door or doors in the entryway of a bathing facility or other area of a building construction.

BACKGROUND

For many years, the most commonly used enclosure for a tub/shower bathing facility has included a pair of sliding glass doors framed in metal. In a typical installation, an outer metal frame circumscribes the entry to the bath and is attached at the sides to the walls of the facility. The installation also includes a header spanning the entrance and a guide rail attached to the tub. The shower doors are hung at the top from the header and guided at the bottom by the rail so that they can slide back and forth in the entryway to allow entry and egress and to create a splash barrier.

There are several disadvantages with the described installation, both functional and aesthetic. First, the doors are always present in the entryway to the bathing area, thus always at least partially blocking the entrance and restricting free access to the bathing area, a special problem when bathing a small child or when cleaning the facility. The header also adds an undesired obstruction in the entryway which must be avoided when entering or leaving the area. Still further, the rail on the tub makes sitting on the edge of the tub undesirable, or uncomfortable at best. Moreover, the metal of the frame and all the glass-to-metal interfaces require special cleaning and maintenance. Apart from these functional constraints, the metal required for the framing, header and rail detracts from a clean and open appearance of the facility.

Although the foregoing disadvantages have been recognized, the known proposed alternatives do not overcome the disadvantages in a commercially acceptable manner. For example, shower doors have been proposed without a header (U.S. Pat. Nos. 4,878,530 to Jean and 5,417,272 to Marlowe et al.), but these doors have frames and still provide inadequate support. The doors in the PCT French publication WO 94/211217 are supported without using a header and do not have the usual frames, but they are believed to lack the support necessary to avoid deflection, as evidenced by the need for corner guides.

Thus, the concept of supporting shower doors in PCT WO 94/211217 would not be acceptable for most applications, particularly for supporting heavy glass doors each weighing from about thirty to fifty pounds. Presumably the WO 94/211217 supporting structure could be made strong enough to support the doors without deflection or sag, but then the structure would be very large, bulky, and unsightly for a bathtub/shower installation. The structure could be made less bulky, but then it would be of reduced strength and incapable of adequately supporting heavy shower doors. Irrespective of its bulk and size, however, the WO 94/211217 design adds protruding metal parts that may be regarded as more obtrusive than the frames and header that have been eliminated.

It is thus emphasized that there are dual problems to solve in providing headerless, frameless shower doors, namely, adequately supporting heavy glass without adversely impacting the appearance of the bathing area. If the sliding glass door sags or rubs or scrapes against the other door or the tub, the installation is commercially unacceptable. If the supporting structure used to support the glass in place of the header and frames is so massive as to be obtrusive in itself, again the installation is commercially unacceptable.

SUMMARY

An enclosure is provided for the entrance to a bathing facility, such as a bathtub/shower combination, or other area that is headerless and thus can be completely opened, as well as completely closed or partially closed or opened as usual, and can also be frameless. The subject enclosure uses duplicate, spaced upstanding columns at opposite sides of and in the entrance to the bathing area to provide the basic support for the shower doors. On one side of the entrance, the enclosure incorporates an integrated mounting apparatus including one of the columns; a cantilever structure extended from the column; and dual shower doors independently cantilevered on the structure so that a vertical plane parallel to the plane of the doors and containing their center of gravity intersects the column. A first of the dual doors is stationary relative to the second dual door, and the second door is translationally moveable relative to the first door to change the degree of closure the bathing facility when the dual doors are in the plane of the entrance. The supporting apparatus also mounts both doors for conjoint pivotal movement in order to move both doors out of the entrance and open it completely. The mounting apparatus enables such translational and pivotal movement to be accomplished without sag or misalignment of the doors and thus without scraping or rubbing of the doors against each other or adjacent surfaces. An important feature in this regard is a carriage having bearings that mount the movable door for movement along a track in the cantilever structure.

An object of this invention is to provide an entrance to a bath or other area that can be completely opened in addition to being completely closed or partially closed or opened.

Another object is to provide a practical enclosure for a bathing facility or other area that can be completely retracted from the entrance to the facility and that emphasizes a clean and open appearance at all times by minimizing the hardware and maximizing the glass showing when the enclosure is in the entrance and by completely opening the entrance when the enclosure is retracted.

A further object is to provide a headerless and frameless enclosure for a bathing facility or other area which is a commercially acceptable alternative to the standard sliding glass doors that are framed and are mounted in and guided by a top header and a bottom rail.

Another object is to support frameless door panels of glass or other material in a headerless bathing facility in side-by-side, spaced upstanding positions so that they can be moved relative to each other or together and into and out of closing, opening and retracted positions, all the while being maintained in such spaced upstanding positions without deflecting, sagging, tipping, tilting, weaving or becoming misaligned and without rubbing or scraping against each other or adjacent surfaces of the facility.

An additional object is to provide an integrated door assembly for a bathing facility or other area which enables pivotal movement of the assembly and translational movement of a door in the assembly and which has mounting brackets or hinges attachable at only two places to the side wall of the facility, such brackets being easily adjustable for aligning the assembly with the facility and for controlling the pivotal movement of the assembly.

A further object is to provide an integrated door assembly for a bathing facility that may be mounted left or right, at either side of the facility, by interchanging the top and bottom mounting brackets or hinges and turning the door upside down.

It is another object to position the mounting and guiding hardware on the glass doors of a bathing area so as to maximize the length of the edge of the glass that is free of framing or other supporting or guiding hardware while still being able to support the panel in a dependable manner.

A still further object is to improve the appearance and functionality of a shower/bath, shower, or other bathing facility or other area, that it is desired to enclose for certain bathing activities and to open fully for other bathing, cleaning or maintenance activities.

It is an additional object to mount a movable glass door in an enclosure to a bathing facility or other area so as to minimize the torque imposed on the supporting structure.

An additional object is to cantilever a movable glass door in an enclosure to a bathing facility other area so as to position the center of gravity of the door close to the plane containing the fulcrum supporting the door.

It is a further object to cantilever door panels independently of each other in a bathing facility other area for movement of at least one of the panels relative to the other panel or panels.

Another object is to cantilever door panels independently of each other in a bathing facility other area for conjoint pivotal or rotational movement of the panels.

Yet a further object is to cantilever multiple door panels independently of each other on a common support in a bathing facility other area for translational movement of at least one of the panels toward and away from the support and for pivotal or rotational movement of both panels about a vertical axis at the support.

An additional object is to provide a carriage or bearing unit for supporting a heavy glass shower door, or like door, on a cantilever for movement along a path lengthwise of a cantilever without deflection about an axis transversely of the path or an axis lengthwise of the path.

Another object is to provide a carriage having the foregoing objectives and also being relatively compact and unobtrusive so as not to detract from the overall appearance of the bathing facility or other area.

Yet another object is to provide a carriage as set forth above that allows use of various types of bearings such as ball, roller or sliding bearings.

A further object is to facilitate cleaning and maintenance of shower doors by minimizing the amount of hardware used.

Yet another object is to minimize the hardware exposed on the inside surface of glass or plastic door panels of a bathing enclosure thereby to facilitate cleaning and to reduce corrosion.

An additional object is to provide appropriate sealing for a bath enclosure having the foregoing characteristics.

A further object is to provide a detent mechanism for positioning pivoting shower doors exactly in the plane of the entrance to a bathing facility.

Still another object to provide a bathing enclosure having the foregoing characteristics which is adjustable both for installation and during use of the enclosure.

These and other objects and advantages of the invention will become apparent upon reference to the accompanying drawings and the following detailed description.

DESCRIPTION OF THE DRAWINGS

FIG. 1 is a front elevation of a bathing facility in which a bathing enclosure incorporating the principles of the present invention is installed between two side walls of the facility.

FIG. 2 is a top plan view of the bathing facility and enclosure of FIG. 1.

FIG. 3 is a vertical edge view taken on line 3—3 in FIG. 1.

FIG. 5(*a*) is an exploded detail of a combined handle/clamp for connecting the outside shower door to the outside cantilever bar.

FIGS. 25–28 are isometric views similar to FIG. 4 but showing various positions of the shower doors in the enclosure of the present invention.

FIGS. 29–35*a* are diagrammatic views showing different configurations of bathing enclosures incorporating the principles of the present invention.

DETAILED DESCRIPTION

Figures 4, 5, 5A:
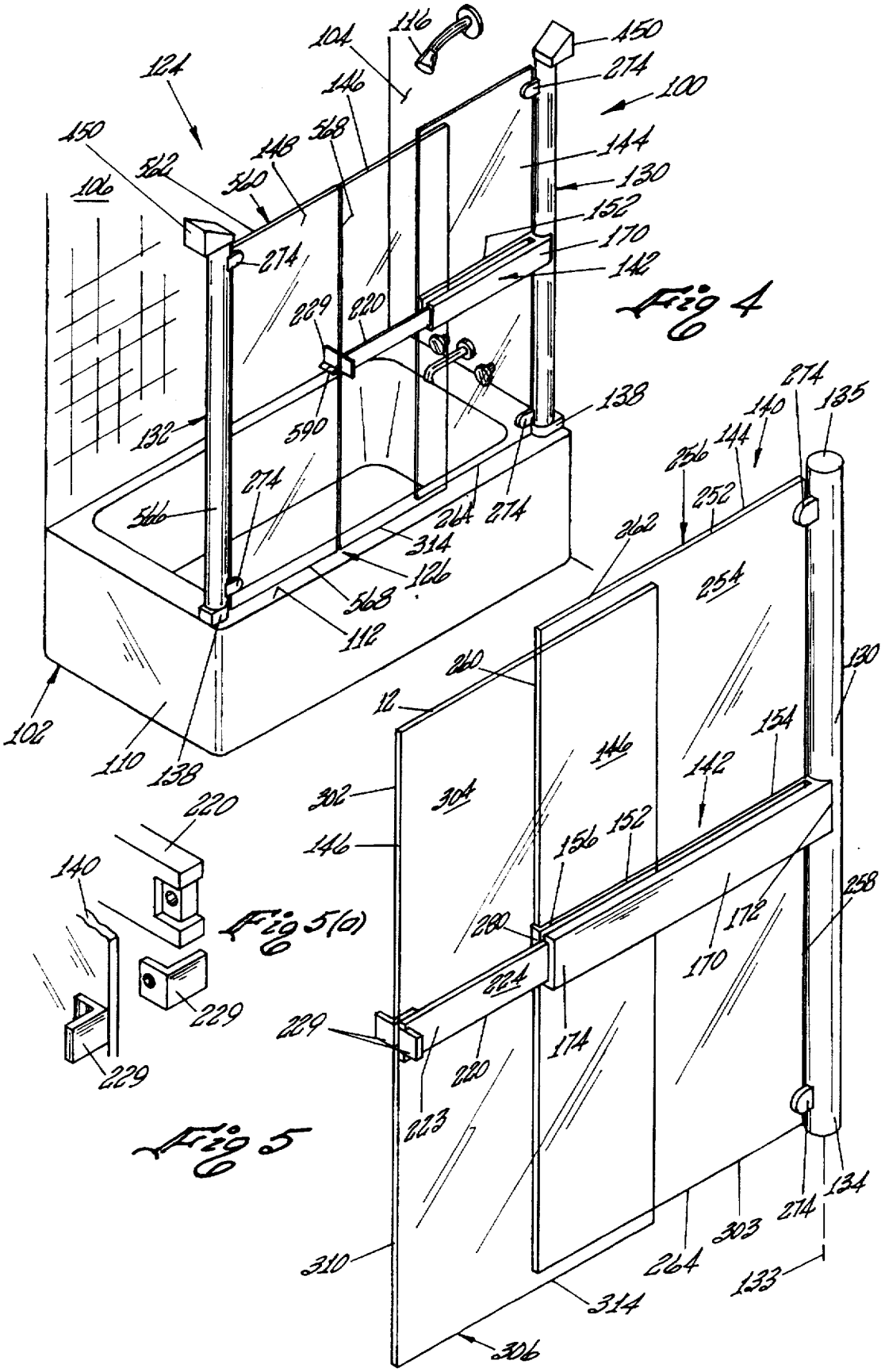
FIG. 4 is an isometric view of the bathing facility and enclosure of FIG. 1 with the wall in the foreground of the facility removed for illustrative clarity.
FIG. 5 is an enlarged isometric view of the integrated door assembly shown in the enclosure of FIGS. 1 through 4, as seen from outside the bathing facility, with its column and dual cantilevers supporting a pair of shower doors.
Figure 6:
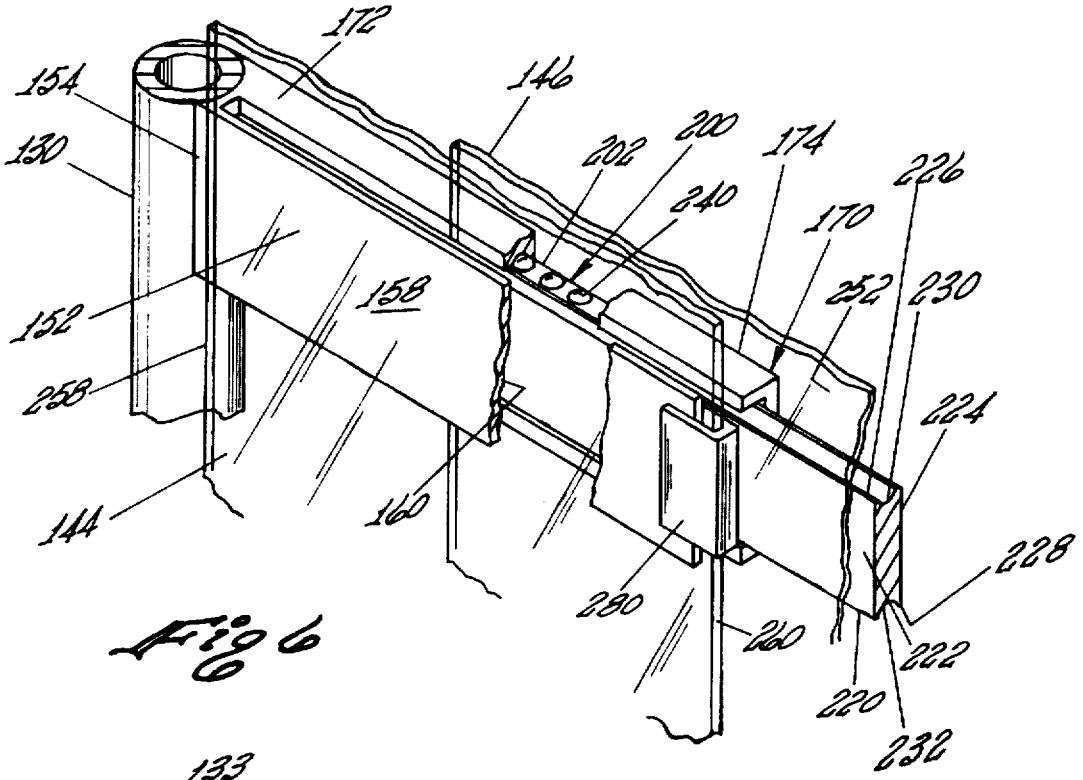
FIG. 6 is a still further enlarged, fragmentary isometric view, partially broken away, of the integrated door assembly of FIG. 5, but as seen from the inside of the bathing facility and also showing part of the carriage and bearings in one of the cantilevers.

With reference to FIGS. 1 through 4, a bathing enclosure 100 incorporating the principles of the present invention is shown in a bathing facility 102. The bathing facility shown and described is typical and includes side and back walls 104 and 106 of a bathroom or other structure; a bathtub 110 having an outer ledge or rim 112; and a shower head 116, tub filler 118 and faucets 120 that project from one of the side walls over the tub. Thus, the enclosure and bathing facility provide a bathing area 124 that has an entrance, entryway or opening 126 defined by a vertical plane 128 (FIG. 2) extending between the side walls and upwardly from the ledge 112.

As the description proceeds, it will be understood that the subject bathing enclosure 100 is not limited to use with the specific bathing facility 102 illustrated and described. The bathing facility can take several other forms, including a shower only, a bathtub only, a steam unit, or the like, any of which provide a bathing area 124 wherein it is desired to enclose the area with a spray- or water-barrier, when using the same, and to open the entrance for access, when entering or leaving the area or when cleaning or maintaining it. Although the subject invention is not dependent on the particular bathing facility, it is significant that use of the subject enclosure allows elimination of a header which typically extends between the side walls 104 in a standard bathtub/shower combination.

With reference to FIGS. 1–5 and in general, the subject bathing enclosure 100 includes main and auxiliary tubular columns 130 and 132 that are respectively right and left in FIGS. 1, 2 and 4. These columns are mounted for rotational movement on their axes 133, in a manner to be described, on opposite sides of the entrance 126 to the bathing area 124 and in the vertical plane 128 thereof. Each column is mounted at its lower end 134 on the ledge 112 of the tub 110 and is attached to its adjacent side wall 104 at its upper end 135 by a top hinge assembly 136 and at its lower end by a bottom hinge assembly 138.

A single shower door 148 (FIGS. 1–5) is mounted on the auxiliary column 132 and is positionable in the plane 128 of the entrance 126. An integrated dual shower door assembly 140 is mounted on the main column 130 and includes a cantilever supporting apparatus 142, that projects perpendicularly from the main column, and parallel, inside and outside shower doors 144 and 146. The inside door is stationary relative to the outside door, and the outside door is translationally moveable relative to the inside door. The dual door assembly is also positionable in the plane of the entrance as that the outside door also moves toward and away from the single door, and in alignment therewith, when they are both in the plane of the entrance. The shower doors are preferably glass doors, weighing from thirty to fifty pounds, but may be of plastics or composites typically used for shower doors.

The cantilever supporting apparatus 142 of the integrated dual shower door assembly 140 is an important aspect of the present invention and is best shown from the exterior in FIGS. 1–5. This supporting apparatus includes an elongated, flat, rectangular, inside cantilever bar 152 having an inner end 154 secured, preferably by welding, to the main column 130; an outer end 156; an inside surface 158; and an outside surface 160. The inside cantilever bar is secured to the main column intermediate its upper and lower ends 135 and 134 and preferably in equidistantly spaced relation therebetween. As best seen in FIGS. 2, 4, 6 and 7, the cantilever bar, or more precisely the plane of the cantilever bar, is slightly offset from the longitudinal axis 133 of the column 130 toward the inside of the bathing facility 102 but is between vertical planes that are tangent to the column. The longitudinal dimension of the bar projects horizontally from the column and its width dimension extends vertically. In the preferred embodiment, the bar is made of one-quarter inch thick aluminum or stainless steel and is about three and three-quarters inches wide by about nineteen and one-quarter inches long.

The cantilever supporting apparatus 142 also includes an elongated, channel-shaped outside cantilever track 170 (FIGS. 1–7) having an inner end 172, an outer end 174, an upper rail 176, a lower rail 178, and a central web 180 interconnecting these rails. The track is secured, preferably by welding, to the column 130 in outwardly juxtaposed relationship to the cantilever bar 152. The track projects horizontally from the column in spaced, side-by-side relationship to the bar, with the web extending vertically. As such, the cantilevered bar and track form a U with the bight of the U connected to the column, with the legs (the bar and track) of the U projecting from the column so that the centerline of the U is in substantially the same vertical plane as the longitudinal axis 133 of the column 130. The web, or more precisely the outside surface of the web, is generally tangential to the column, as best seen in FIGS. 2, 4, 5 and 7, and the rails extend horizontally toward the cantilever bar 152 in coplanar relation to the upper and lower edges of the bar. It is thus seen that the cantilever bar and the cantilever track are independently fixed to, and supported by, the column so that they depend on the column, but not on each other, for their support. In the preferred embodiment, the track has an outside width of about four inches, a thickness of about five-sixteenths of an inch, a length of about twenty and one-half inches, and is preferably made of aluminum or stainless steel. The track is thus of greater thickness and strength than the bar.

With reference to FIGS. 6, 7, and 13–16, in particular, the upper and lower rails 176 and 178 of the cantilever track 170 have elongated, upper and lower, adjustable inserts 182 and 184 extending the length of the rails. Each insert has a width less than the width of its adjacent rail so that it can move transversely of the track inwardly and outwardly relative to the bathing area 124. Each insert is held and adjusted by a clamping bolt 186 that extends through a clearance hole in its rail into the adjacent insert. When the bolt is loosened, the associated insert can be moved in or out, and when the bolt is tightened, the insert is held securely in the adjusted position. The adjustment inserts have opposed and vertically aligned, longitudinal, concave upper and lower grooves 190 and 192 facing downwardly and upwardly, respectively, within the channel formed by the track 170.

A carriage or bearing unit 200 (FIGS. 6, 7, and 13–16) includes a U-shaped bearing cage 202 complementarily received within the channel of the track 170. The cage has upper and lower horizontal flanges 204 and 206 in adjacent, spaced parallel relation to the upper and lower rail inserts 182 and 184, respectively, of the track and a vertical central web 208 in adjacent, spaced relation to the central web 180. The upper and lower flanges of the cage have a plurality of upper and lower circular holes 210 and 212, respectively, with the holes in the upper set being aligned with corresponding holes in the lower set, as best shown in FIG. 14, and with the two rows of holes aligned with the grooves 190 and 192 in the rail inserts. As will be better understood as the description proceeds, the number of holes in each flange of the cage can be varied, but in the illustrated embodiment, each flange has ten holes.

The carriage 200 (FIGS. 6, 7, and 13–16) further includes an elongated, flat rectangular outside carriage bar 220 having an inner end 221, an inside surface 222, an outer end 223, an outside surface 224, an upper edge 226, and lower edge 228. A combined handle and glass clamp 229 (see also FIG. 5(*a*)) extends transversely in both directions from the outer end of the carriage bar. The upper and lower edges of the outside bar have longitudinal, upper and lower grooves 230 and 232, respectively. The carriage bar extends horizontally and is received within the track 170 so that the upper and lower grooves thereof are respectively in opposed, spaced relationship to the upper and lower grooves 190 and 192 in the rail inserts 182 and 184 and in alignment with the upper and lower sets of holes 210 and 212 in the cage 202. The carriage also includes upper ball bearings 240 that are received in the upper set of holes 210 in the cage and that roll in the upper grooves 190 and 230. Similarly, the carriage has lower ball bearings 242 that are received in the lower set of holes 212 and roll in the lower grooves 192 and 232. The bearings are preferably made of a suitable plastic, such as Delrin plastic or Teflon-filled Delrin plastic because of the quiet characteristic of such material, or of stainless steel.

In the preferred embodiment (FIGS. 6, 7, and 13–16), the carriage bar 220 has a length of about twenty-one and seven-eighths inches, a width of about two and one-half inches, and a thickness of five-eighths inches; and the cage 202 has a length of about five inches. The carriage bar is preferably aluminum or stainless steel, and the cage is preferably of polycarbonate plastic. Thus, it is seen that the cage is free to move in both directions relative to the track 170 and the carriage bar, with the bearings 240 and 242 rolling along the inserts 182 and 184 of the rails 176 and 178 in the grooves 190 and 192 and along the outside bar in the grooves 230 and 232. At the same time the carriage bar is free to move telescopically relative to the track and the cage between a retracted, position fully concealed, or nearly so, within the track, and an extended position projecting endwardly from the track.

Figure 13:
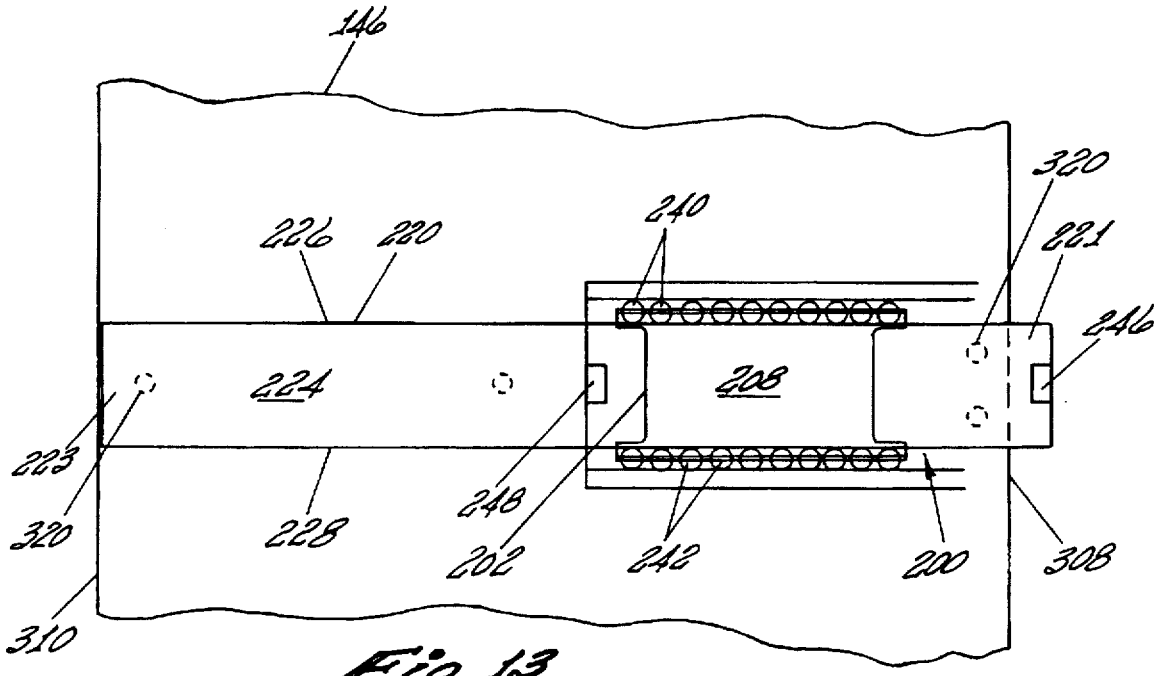
FIG. 13 is a partially diagrammatic side elevation looking at the cantilever track from the outside of the bathing area but looking through the vertical web of the track at the carriage to see its bearing cage, ball bearings and outside bar and showing a fragmentary side elevation of the outside shower door.
Figure 14:
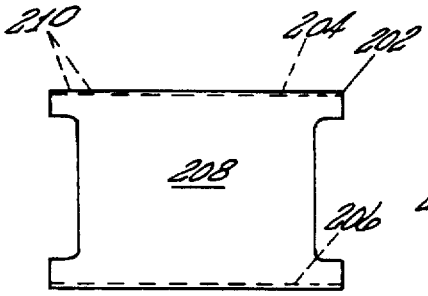
FIGS. 14, 15, and 16 are detail views of the parts of the carriage shown in FIGS. 7 and 13.
Figure 16:
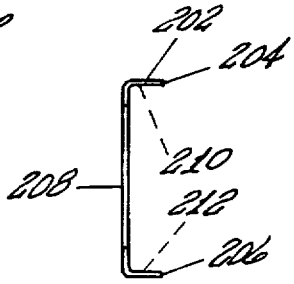
Figure 15:
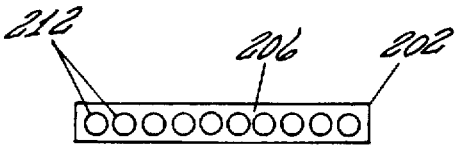
Figure 17:
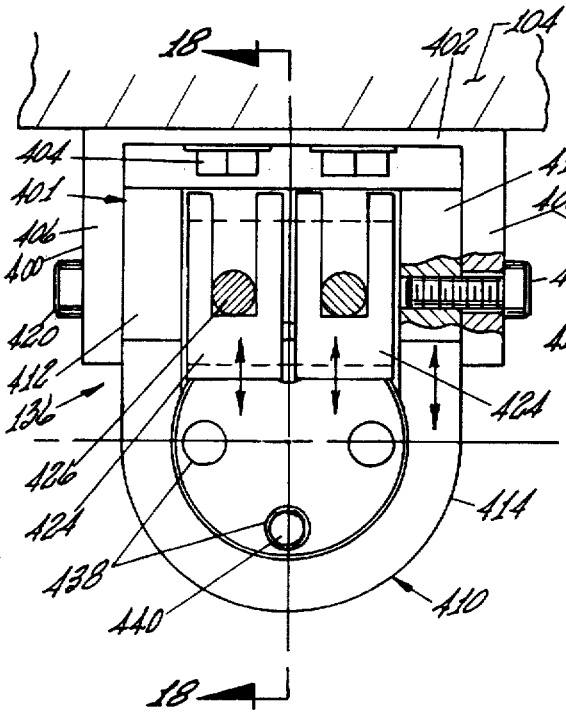
FIG. 17 is an enlarged top plan view of the right-hand column illustrated in FIGS. 1–4, taken along a plane indicated by line 17—17 in FIG. 3, that is, with the cap covering the column removed, and showing a hinge or bracket assembly between the top of the column and the wall including stops for the door assembly.
Figure 18:
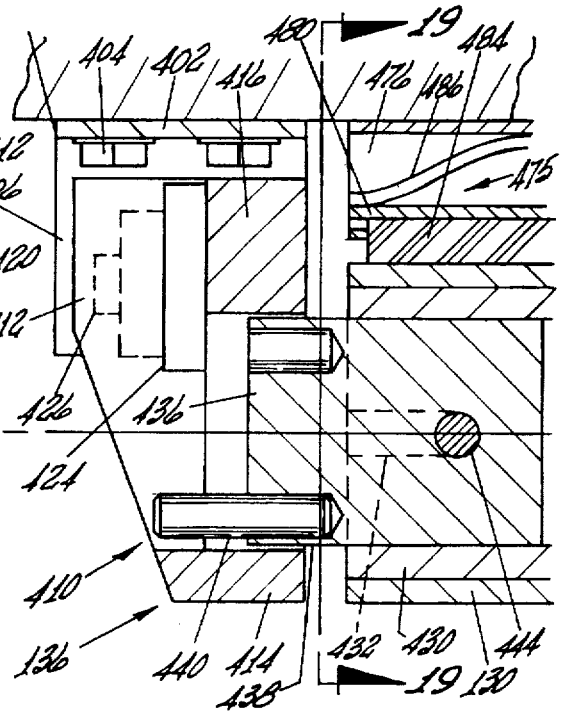
FIG. 18 is fragmentary vertical section taken on line 18—18 in FIG. 17 but also showing a seal between the column of the door assembly and the facility.

Endward movement of the cage 202 (FIGS. 6, 7, and 13–16) and the carriage bar 220 is limited by inner and outer stops 246 and 248 (FIG. 13). The outer stop extends transversely from the web 180 of the track 170 at its outer end 174 into the channel of the track and into the path of movement of the web 208 of the cage. Thus, as the cage moves toward the outer end 174 of the track, the outer end of the web eventually strikes the outer stop, preventing further endward movement of the cage. The inner stop extends transversely from the inner end 221 of the carriage bar into the channel of the track and also into the path of movement of the web of the cage. Thus, as the carriage bar moves toward its extended position, the inner stop eventually strikes the inner end of the cage limiting further endward movement of the bar. Retracting movement of the carriage bar is limited either by engagement of the handle 229 with the outer end 174 of the track and/or by engagement of the bar with the inside of the main column 130.

The inside shower door 144 (FIGS. 1–7) of the double door assembly 140 has an inside surface 252, an outside surface 254, and a circumferential edge 256. The circumferential edge has an inner segment 258, an outer segment 260, an upper segment 262, and a lower segment 264. The height of the inside shower door and of the other two doors 146 and 148 is the same and equal to the height of the columns 130 and 132, but the width of the doors may vary. As between the inside and outside shower doors, the inside door is preferably wider than the outside door. Furthermore, the inside door is the same width as the length of the inside cantilever bar 152, and the outside shower door has a width about the same as the length of the carriage bar 220 of the carriage 200, but is such that in the retracted position of the outside door, it does not contact the column 130 or the bolted clamps 274.

Figure 19:
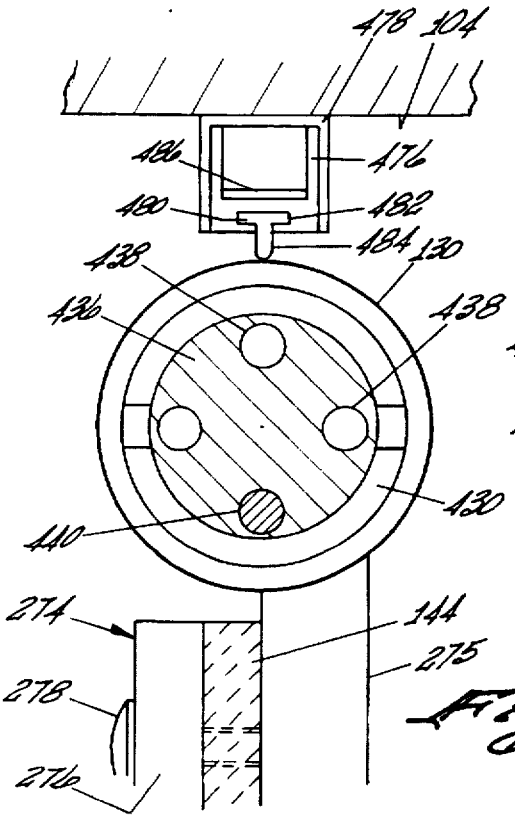
FIG. 19 is a fragmentary horizontal section take on line 19—19 in FIG. 18.

The inside shower door 144 (FIGS. 1–7) is hung from the main column 130 by upper and lower bolted clamps 274 adjacent to the upper and lower ends 72 and 74 of the column. The door is hung with its upper and lower edge segments 262 and 264 approximately coterminus with the upper and lower ends 135 and 134 of the column, respectively; with its outside surface against the inside surface 158 of the inside cantilever bar 152; and with its outer edge segment 260 coterminus with the outer end 156 of the cantilever bar 152. Each bolted clamp (FIG. 19, but see also FIGS. 21 and 22 for the same type of clamp used on the single shower door 148) includes an ear 275 secured, as by bolt 521 in (FIG. 21), to the column and engaging the inside surface 252 of the door; a clamping plate 276 engaging the outside surface 254 of the door; and a bolt 278 FIG. 22) extending through a bushing in a clearance hole in the door (for door adjustment) in the door, and into the ear. Preferably, rubber liners are interposed the interfaces of the ear, the door, and the clamping plate, as shown in FIG. 22, and are used at all the other interfaces of glass and clamps in the enclosure 100. A U-shaped friction clamp 280 (FIG. 6) fits over the adjacent outer edge segment 260 of the inside door and the cantilever bar thereby firmly securing the inside door to the cantilever bar. It is important to note that the inside shower door (FIGS. 1–7) is disposed inwardly of the cantilever bar so that the latter is not exposed to water from the bathing area 124.

As above noted, the shower doors 144, 146 and 148 are preferably made of glass of selected dimensions. In one embodiment, for example, the inside door 144 has a thickness of about three-eighths inch, a length or height of about fifty-four inches, and width of about twenty inches. It will be understood, however, that the height of the doors (as well as the height of the columns which is approximately the same), depends on the particular bathing facility or installation, as 102, with dimensions in the order of fifty-four inches and seventy-two inches being examples of preferred heights. The width of the doors also depends on the particular installation, and examples are given herein, but the double door assembly 140 is preferably manufactured in a limited number of sizes, whereas the single door may be cut to fit and fill the particular entrance opening 126.

The outside shower door 146 (FIGS. 1–7 and 13) has an inside surface 302, an outside surface 304, and a circumferential edge 306. This circumferential edge includes an inner segment 308, an outer segment 310, an upper segment 312, and a lower segment 314. The outside shower door has a width less than the length of the carriage bar 220 and is secured to the inside surface 222 thereof by bolted clamps 320 (FIG. 13) in a manner similar to attachment of the inside door 144 to the column 130 by clamps 274, as described above. In addition the handles 229 (FIG. 5(*a*)) clamp the outer edge segment to the cantilever bar by a bolt, not shown, but similar to bolt 278 in FIG. 22. The inner segment 308 of the outside door is in inwardly adjacent spaced relation to the inner end 221 of the carriage bar (FIG. 13), and the upper and lower edge segments 312 and 314 are adjacent to the upper and lower ends 135 and 134 of the columns 130 and 132.

Figure 7:
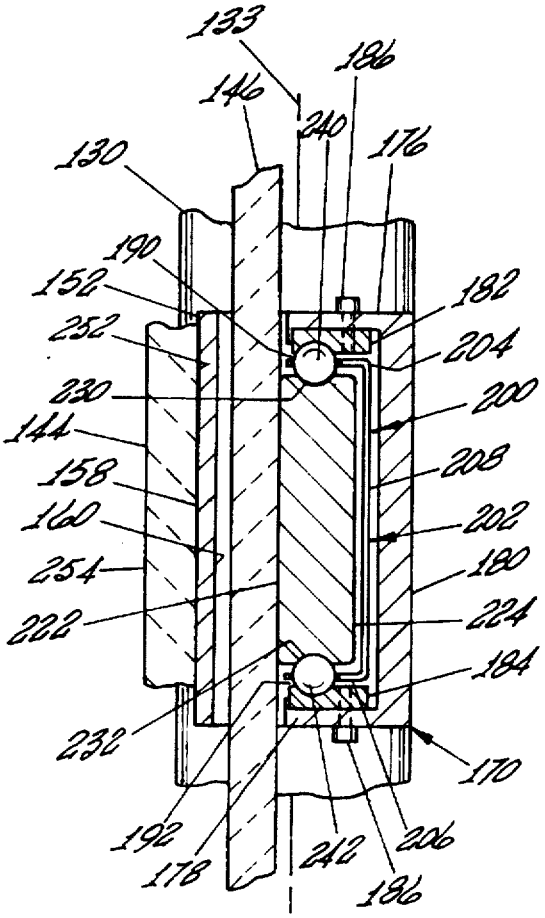
FIG. 7 is an enlarged, fragmentary vertical section taken on line 7—7 in FIG. 2.

As best shown in FIG. 7, the outside shower door 146 is mounted in a vertical position between the cantilever track 170 and the cantilever bar 152 in spaced parallel relation to the inside shower door 144. Furthermore, the outside shower door is in closely spaced relation to the rails 176 and 178 of the track as well as the flanges 204 and 206 of the cage 202. As a result, the plane of the outside shower door intersects the column 130 in closely spaced relation to the longitudinal axis 133 of the column. By loosening the bolts 186, however, the plane of the outside shower door 146 can be tilted slightly about an axis $A_1$ (FIG. 23), longitudinally related to the translational path of travel of the outside door, to adjust the parallelism of the inside and outside doors and also to adjust the alignment of the outside door with the single door, after which the bolts are tightened to set the desired angle of the outside door. As with the inside shower door, one embodiment of the outside shower door has a thickness of about three-eighths inch, a height or length of about fifty-four inches, and a width of about eighteen and three-quarters inches.

Figure 20:
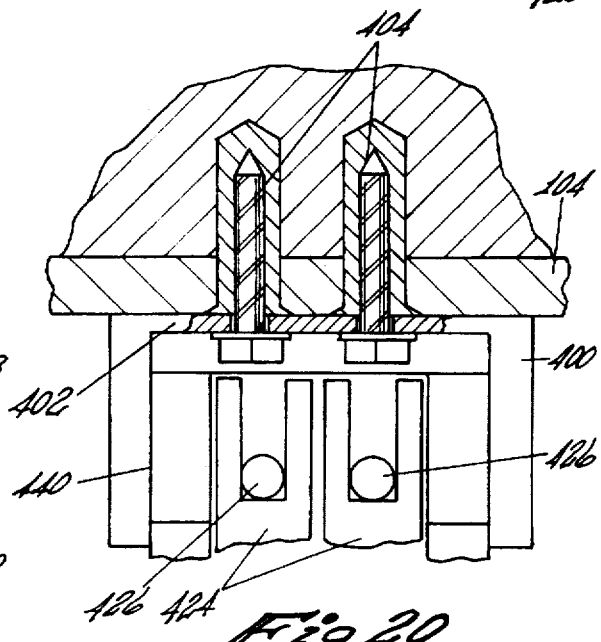
FIG. 20 is a fragmentary view similar to FIG. 17 but with parts broken away to show in more detail how the column is attached to the wall of the facility.

As above stated, the columns 130 and 132 (FIGS. 1–3 and 17–22) are identical in construction and mounting, and thus the features of only one column will be described in detail. Thus, the main column 130 is made of metal, preferably aluminum or stainless steel, with the preferred embodiment having an outside diameter of approximately four inches and a height of about fifty-four inches. As earlier explained, the column is mounted in its upright position by the top and bottom top hinge or bracket assemblies 136 and 138. The top hinge assembly includes a top mounting bracket 400 having a back plate 402 secured to the side wall 104 by suitable fasteners 404, such as screws in anchors or the like (FIG. 20), and a pair of spaced parallel vertical ears 406 projecting out from the wall. A mounting block 410 is slidably fitted in the mounting bracket and has a pair of spaced parallel flanges 412 slidably engaging the ears. The block provides a cylindrical aligning bushing 414 concentric to an upright axis and a horizontal cross plate 416 joining the flanges in generally tangential relation to the bushing. Bolts 420 extend through the ears and the flanges to secure the mounting block to the mounting bracket once the block is properly positioned in the bracket, as will be described. A pair of horizontal, U-shaped stop pieces 424 is slidably positioned in side-by-side relationship on the cross plate in overlapping relation to the bushing, and bolts 426 extend between the legs of the stop pieces and into the cross plate for individually adjustably retaining the stop pieces in various degrees of overlap with the bushing for a purpose to be described.

Figure 21:
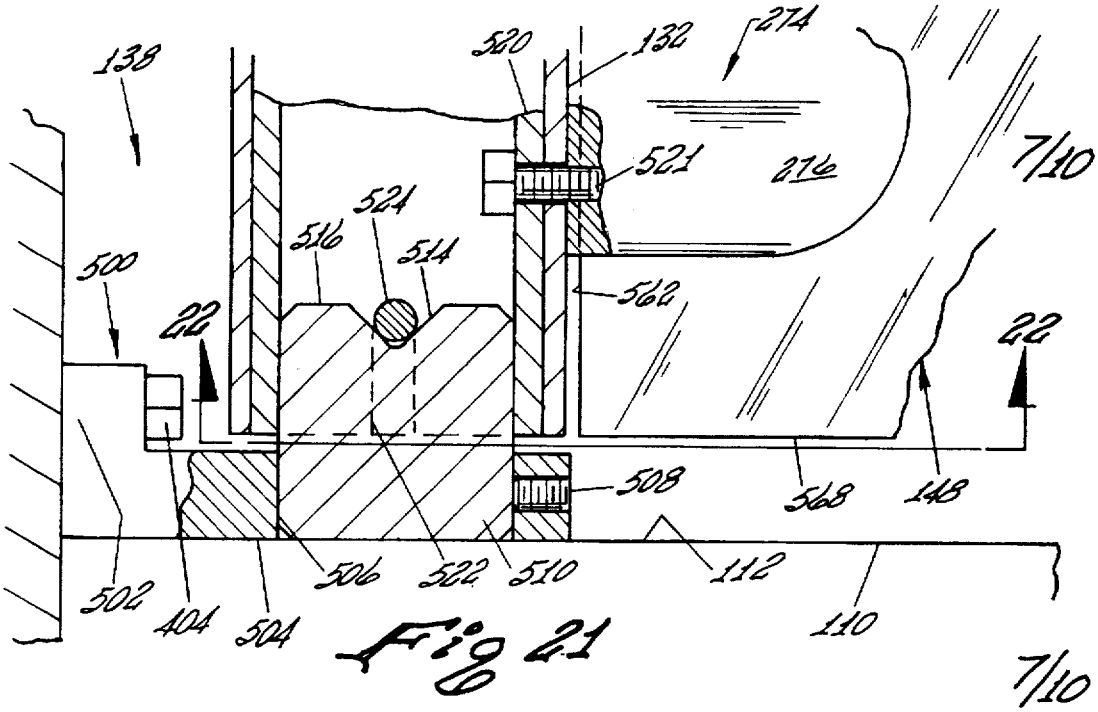
FIG. 21 is an enlarged fragmentary view, partly in elevation and partly in vertical section, of the base of the left-hand column shown in FIG. 1 with parts broken away to show a detent mechanism used to position the door assembly, it being noted that the columns and their hinge assemblies are identical and interchangeable.
Figure 22:
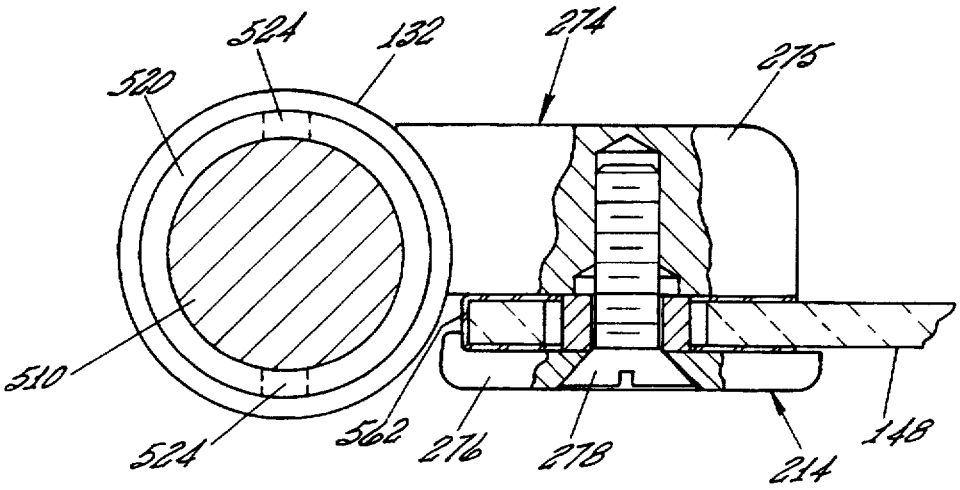
FIG. 22 is a horizontal section taken on line 22—22 in FIG. 21.

An internal upper sleeve 430 (FIGS. 17–19) is secured within the upper end 135 of the column 130, in a manner shown and subsequently to be described in connection with the bottom hinge assembly 138 (FIG. 21). The upper sleeve (FIG. 18) is coterminus with the upper end of the column and has a pair of short slots 432 that extend longitudinally from the end and along the sides of the sleeve in opposed relation to each other. A trunnion 436 is rotatably received in the bushing and axially slidably received in the sleeve. The trunnion has four equally spaced, endwardly opening holes 438 at the quadrants of the trunnion for receiving a stop pin 440. A lug or pin 444 extends radially outwardly from the trunnion and is slidably received in one of the slots to preclude rotation of the trunnion in the sleeve. The top hinge assembly also includes a cap 450 (FIGS. 1–4) fitted over and covering the bracket 400 and the upper end 135 of the column.

Thus, during installation, with the column 130 in its bottom hinge assembly 138, with the cap 450 not yet in place, and before the bolts 420 are in place (FIGS. 17–20), the upper trunnion 436 is inserted in the aligning bushing 414. The column 130 is then plumbed vertical while at the same time adjusting the vertical spacing between the ledge 112 and the lower edge segments 264 and 314 of the inside and outside shower doors 144 and 146. Holes are then drilled in the mounting block 410 and bracket 400, and the bolts 420 are inserted to secure the mounting block 410 in fixed position relative to the mounting bracket 400 and thereby set the orientation of the dual doors about an axis $A_2$ (FIG. 24), transversely related to the path of translational movement of the outside shower door. It is thus to be understood that the shower doors 144, 146 are substantially vertical and parallel to the back wall 106 but may tilt relative to the side wall 104 so that the column is adjusted to be square with the bathtub ledge 112 and the shower door edge segments 263, 314 is adjusted to be in spaced parallel relation to the ledge.

The column 130 (FIGS. 1 through 4, 17 through 19) is therefore mounted for rotational movement in the mounting bracket 400 and is oriented in a substantially vertical attitude, and the double shower doors 144, 146 are properly spaced from the ledge 112. As the column rotates relative to the trunnion 436, the stop pin 440 engages the stop pieces 424 to limit rotation of the column and thus of the double door assembly 140. The stop pin is placed in different holes 438 to select the total angle of rotation of the column and double door assembly in a manner more fully described below.

A sealing mechanism 475 (FIGS. 1, 18, and 19) is positioned between each column 130, 132 and its adjacent side wall 104 for preventing water passage between the column and the wall. Only the sealing mechanism for the right column 130 will be described in detail since both mechanisms are identical. Thus, the sealing mechanism (FIGS. 18 and 19) includes a pair of slidably interfitting, face-to-face, elongated inner and outer channels 476 and 478 whose length is the same as the length of the column. The back of the outer channel is attached to the side wall between the wall and the column and in parallel relation to the column, so that in this position, the inner channel slides in and out of the outer channel toward and away from the column.

The inner channel 476 (FIGS. 18 and 19) has an elongated vertical T-shaped slot 480 extending the full length of the inner channel in the back thereof and opening at both ends of the channel as well as laterally toward the column. An elongated T-shaped brush-or-lip type seal 482, of a suitable rubber or plastic sealing material, is slidably fitted in the slot and has a blade 484 extending from the inner channel toward and into wiping engagement with the column. An elongated undulated spring 486 is fitted in the channels, extends the full length thereof, and resiliently bears against the insides of the webs of the channels. The spring thus presses the blade resiliently against the column in order to provide a seal between the wall and the column and to maintain this seal during rotation of the column, as well as adjustment of the column in the manner described above.

The bottom hinge assembly 138 (FIGS. 1, 4, 21 and 22), as previously noted, is the same for both columns 130 and 132, but as contrasted with the top hinge assembly 136, is described with the left or auxiliary column 132. Thus in FIG. 21, the bottom hinge assembly includes a lower bracket 500 having a vertical flange 502 secured to the side wall 104 adjacent to the ledge 112 of the bathtub 110 by fasteners 404. The bracket also includes a base plate 504 extending away from the wall and resting on the ledge of the bathtub. The plate has a vertically disposed, circular bore 506, and a set screw 508 extends through the plate and radially into the bore. A lower trunnion 510 is fitted in the bore for rotatable adjustment therein, is fixed in the bore in selected positions by tightening the set screw, and extends upwardly from the plate. The lower trunnion also has a diametrically extending, upwardly open detent notch 514 and a pair of upper plateaus 516 at the edges of the notch.

An internal lower sleeve 520 (FIGS. 21 and 22), identical to the upper sleeve 430, is secured by a bolt 521 within the lower end 134 of the column 132 so that it is coterminus with the lower end. The bolt 521 extends through the sleeve, the column and into the ear 275 of the clamp 274 so that the bolt serves not only to secure the sleeve in the column but also to secure the clamp to the column. Each of the two upper sleeves 430 and two lower 520 sleeves and each of the four clamps 274 is similarly attached to its column 130 and 132 in this manner. The lower sleeve 520 has a pair of short slots 522 that extend longitudinally upwardly from the lower end of the column and along the sides of the sleeve in opposed relation to each other, just as with the upper sleeves.

The lower sleeve 520 (FIGS. 21 and 22) is rotatably coaxially fitted down over the lower trunnion 510 with the upper closed ends of the slots 522 at the level of the detent notch 514. A detent pin 524 extends diametrically of the sleeve and has opposite ends projecting into the slots so that when the slots and the notch are aligned, the pin is in the notch. When the column, and therefore the sleeve, rotate on the trunnion, the detent pin turns relative to the trunnion. If the pin is initially in the notch, such rotation cause the pin to ride up along the notch and up onto the plateaus 516, thereby lifting the column, and vice versa, if the pin is on the plateaus, sufficient rotation of the column causes the pin to drop into the notch.

The detent pin 524 and notch 514 (FIGS. 21 and 22) are provided for the purpose of aligning the shower doors 146 or 148 with each other and in the plane 128 of the entrance 126 to the bathing area 124. When the lower trunnion 510 is initially installed in the base plate 504, it is rotationally adjusted prior to tightening the set screw to orient the detent notch perpendicularly to the plane of the entrance. Correspondingly, the detent pin is positioned in the lower sleeve 520, by virtue of positioning the slots 522, so that the slots and pin are perpendicular to the plane of the shower door 148, or 146. Therefore, when the column rotates on the lower trunnion, the door 148 is placed exactly in the plane of the entrance when the detent pin is in the notch.

Again, it is understood that the description has referred to the auxiliary or left column 132 in explaining the bottom hinge assembly 138 (FIGS. 1–4) but that the association of the main or right column 130 with its the bottom hinge assembly is identical, albeit on the other side of the entrance 126.

It should also be noted that the double door assembly 140 can be located either left or right in the entrance, as 126, to a bathing facility, as 102, by merely inverting the assembly and mounting it "upside down," as it were, in the top and bottom hinge assemblies at the other side of the facility. Having thus described in detail the double door assembly 140 and its mounting, in the bathing facility 102, reference is now made to the single shower door 148 and its mounting in the facility. Because the parts are identical, the same numbers are used for the same parts.

Thus, the auxiliary column 132 (FIGS. 1 through 4) is mounted in the bathing facility 102 by top and bottom hinge assemblies 136 and 138 that mount the auxiliary column for rotational movement just like the main column 130. The single shower door 148 has a circumferential edge 560 including upper, lower, inner, and outer segments 562, 564, 566, and 568. As above noted, the single shower door has the same height as the columns 130 and 132 and as the other doors but its width depends on the particular installation. That is, the width of the single door is cut to fill the space between the extended dual doors 144, 146 and the auxiliary column. The single door is hung from the auxiliary column by upper and lower clamps 274 adjacent to the upper and lower ends 72 and 74 of the column, with its upper and lower edge segments 562 and 564 coterminus with the upper and lower ends 72 and 74 of the column, respectively. A through handle 590 projects outwardly and inwardly from the door adjacent to its outer edge segment and in alignment with the cantilever supporting apparatus 142 when all of the doors are in the plane 128 of the entrance 126. Also a sealing mechanism 475 is interposed the side wall 104 and the auxiliary column.

ALTERNATIVE EMBODIMENTS OF THE CARRIAGE

Figure 8:
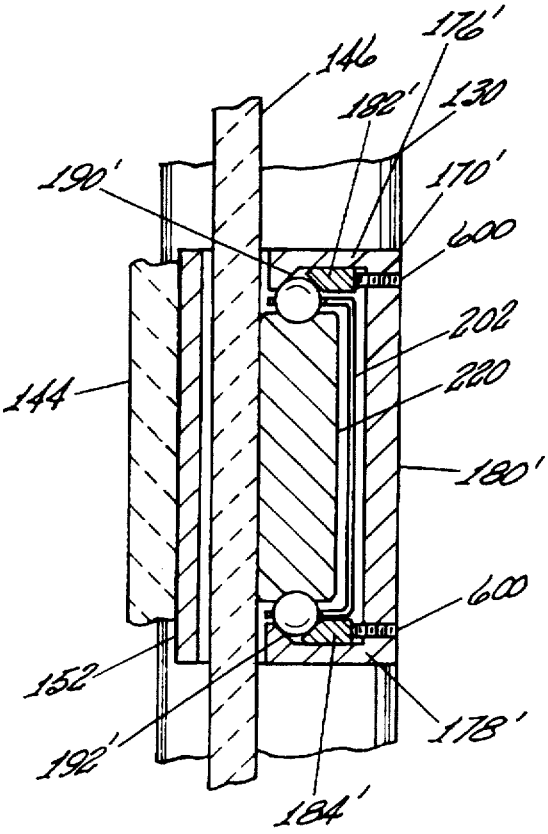
FIG. 8 is a view similar to FIG. 7 but showing another embodiment of the carriage.
Figure 9:
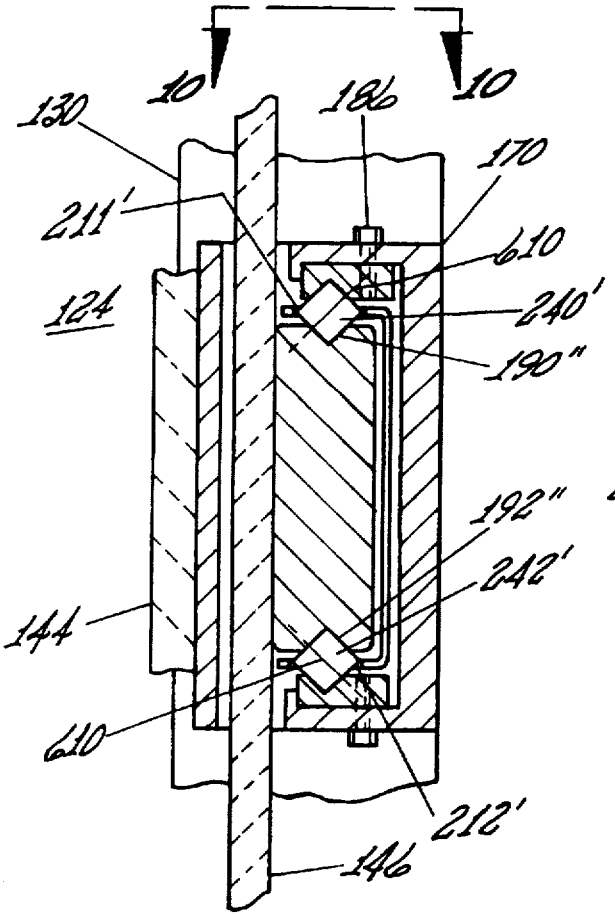
FIG. 9 is a view similar to FIG. 7 but showing still another embodiment of the carriage.
Figure 10:
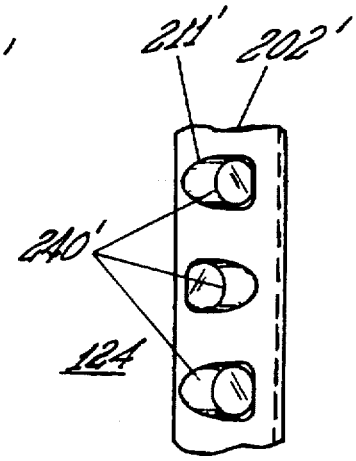
FIG. 10 is a fragmentary plan view seen from a position indicated by line 10—10 in FIG. 9.

Three other embodiments of the carriage 200 of FIG. 7 are illustrated in FIGS. 8, 9 and 10 wherein the same parts are given the same reference numeral as FIG. 7 and modified parts are indicated by the reference numeral of FIG. 7 with the addition of a prime. In the embodiment of FIG. 8, the track 170' has upper and lower rails 176' and 178' each of which is turned into the channel of the track to form part of its respective upper and lower grooves 190' and 192'. Adjustment inserts 182' and 184' of the rails are movably received in the track and form the other part of the grooves in the rails. These inserts are movable transversely of the track, as before, but here, they are adjusted by set screws 600 laterally engaging the inserts and extended through the web 180' of the track, as will be understood from FIG. 8. As with the embodiment of FIG. 7, by turning the upper set screw in and backing out the lower set screw, or vice versa, the plane of the outer shower door is adjusted about the axis Al (FIG. 23) extending longitudinally of the path of translational movement of the outside shower door 146.

In the embodiment of FIG. 9, the ball bearings 240 and 242 are replaced by roller bearings 240' and 242', the concave upper and lower grooves 190 and 192 are replaced by V-shaped grooves 190" and 192", and the circular cage holes 210 and 212 are replaced by specially shaped holes 211' and 212'. Moreover, to balance the load on the roller bearings, the axes 610 of rotation of the bearings are alternately tilted in opposite directions, and vertically aligned upper and lower rollers are tilted in opposite directions from each other. As seen in FIG. 10, for example, the lowermost bearing in that view has its axis tilted inwardly of the bathing area 124, the middle bearing has its axis tilted toward the outside of the bathing area, the upper bearing has its axis tilted inwardly of the bathing area, and so forth.

Figure 11:
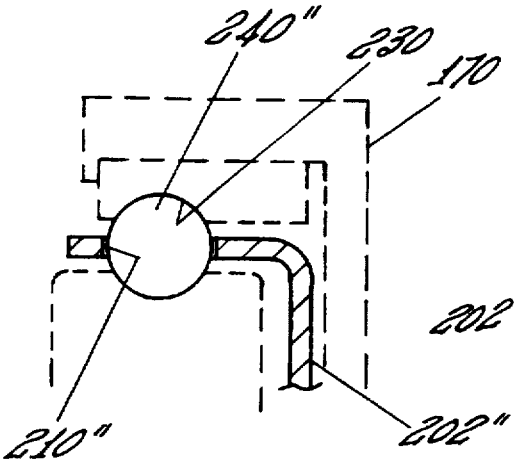
FIG. 11 is a fragmentary section of a portion of yet another embodiment of the carriage as used in the present invention.
Figure 12:
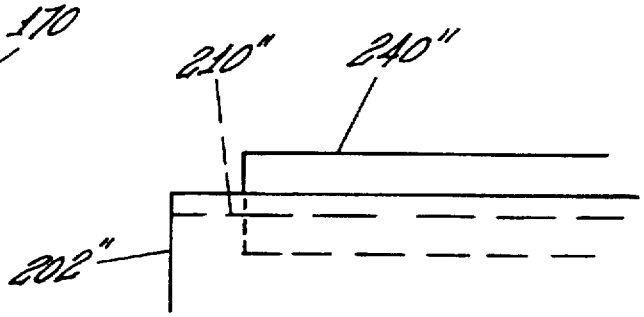
FIG. 12 is a side view of the carriage shown in FIG. 11.

The embodiment of FIGS. 11 and 12 replaces the ball and roller bearings, as 240 and 240', with two, upper and lower, elongated cylindrical slide bearings 240", only the upper one of which is illustrated. In this embodiment, a cage 202" has upper and lower elongated openings, as 210", which receive the slide bearings, the latter riding in upper and lower grooves 230 and 232, not shown in FIG. 11 and 12, but as before. Whereas the ball and roller bearings 240, 242, 240', and 242' are made of a plastic like Delrin or of stainless steel as above explained, the slide bearings are preferably made of Teflon or suitable low friction material or a composite member such as a coated rod.

These alternative embodiments demonstrate the essential equivalence of various types of bearings for use in the carriage 200. Although the preferred embodiment is as shown in FIG. 7 and described above, other bearings including but not limited to the alternatives described and shown herein, may serve the intended purposes in particular applications. It is also to be noted that movement of conventional shower doors is often referred to as "sliding' movement although in fact the doors may be hung on roller bearings or wheels in a header bar and not sliding bearings. Thus, in view of this common parlance, it will be understood that if the outside shower door 146 is described as a "sliding door," such description does not limit the door to being mounted on a carriage using a slide-type bearing, as shown in FIGS. 11 and 12, but equally embraces ball and roller bearings or wheels.

Although the bathing enclosure 100 of the present invention has been fully described above, it is important to understand the mechanics involved in its construction and operation. It is first to be emphasized that glass shower doors, as 144 and 146, of the type used in the subject enclosure, have considerable weight, for example, from thirty to fifty pounds, as previously noted. Although the absence of the header and frames around the doors presents a very attractive clean and open appearance for the bathing facility, if such heavy doors are not properly supported, the diminished function overshadows the improved appearance, and the construction becomes commercially unattractive. With the cantilever supporting apparatus 142 of the present invention, however, the doors are properly supported so that there is no sagging or misalignment of the doors and no scraping or rubbing of the doors against each other or against adjacent surfaces. The force diagrams of FIGS. 23 and 24 help in understanding why the doors are properly supported with the subject invention.

Figure 23:
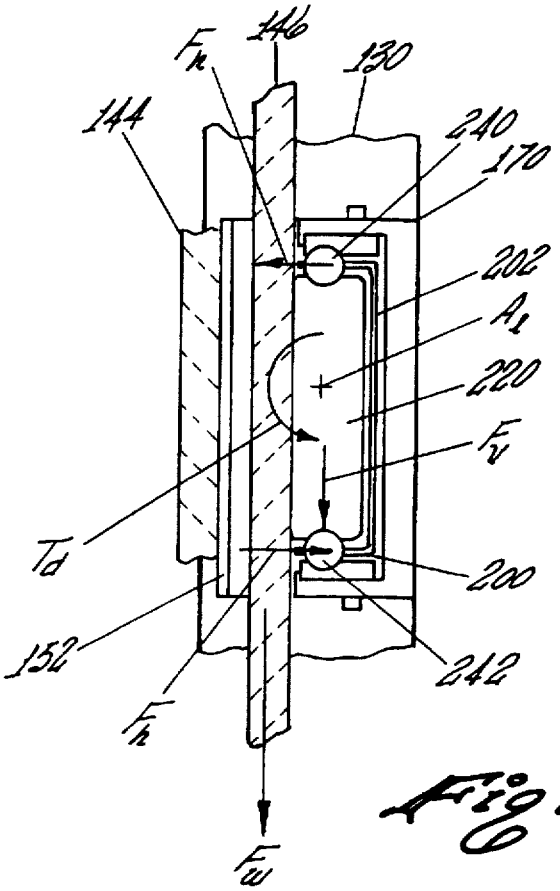
FIG. 23 is a view similar to FIG. 7 but is a force diagram including force vectors to aid in understanding the mechanics of the subject enclosure.
Figure 24:
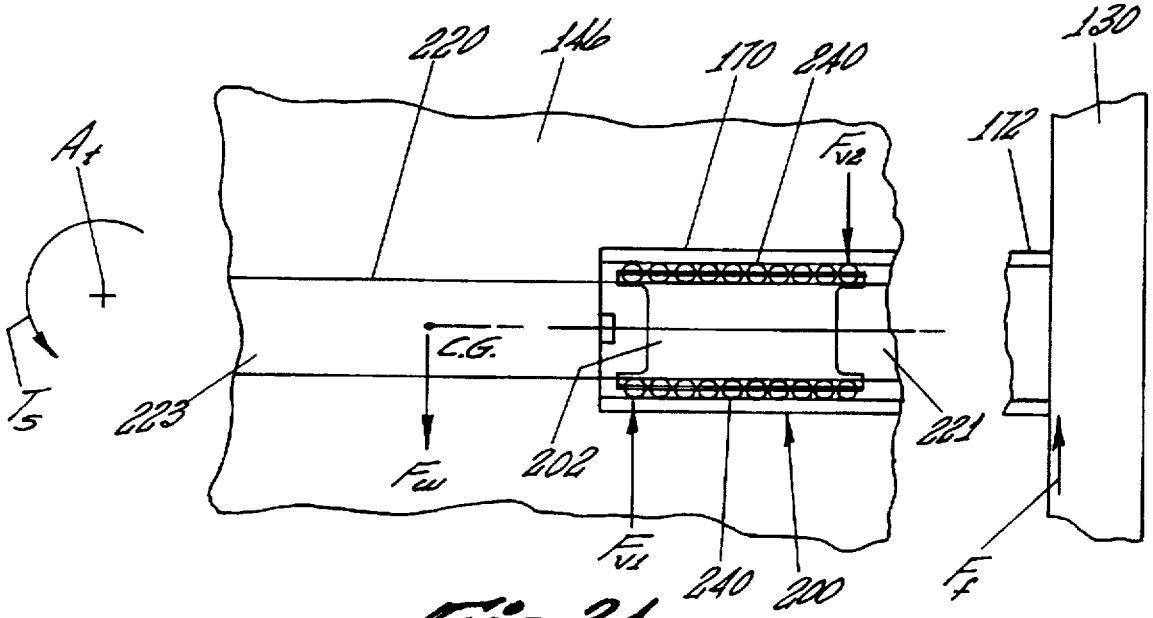
FIG. 24 is a view similar to FIG. 13 but is also a force diagram to aid in understanding the mechanics of the subject enclosure.

With reference then to the force diagrams shown in FIGS. 23 and 24, the forces acting on the cantilever supporting apparatus 142 are shown and described. It is first to be recognized that the forces acting on the outside shower door 146 are of primary concern. As this door moves out along the cantilever track 170, the moment arm increases thereby increasing the torque $T_d$ and $T_s$ in two directions on the supporting apparatus 142. If this torque is not minimized, either the door will not be properly supported or else the supporting mechanism needed will be too large and bulky for a bathing application. By separately cantilevering and supporting the inside door 144, the latter does not additionally burden the track in its support of the outside door. Thus, the analysis of the mechanics is concerned with the forces on the track.

First, the center of gravity CG of the outside door 146 (FIGS. 23 and 24) and the cantilever supporting apparatus 142 is indicated in FIG. 24, and the downward force caused by the weight of the outside door and the cantilever supporting apparatus is indicated by the force vector $F_w$. This force $F_w$ imposes torques $T_d$ and $T_s$ on the supporting apparatus 142, and more particularly on the main column 130 and the cantilevered track 170, about two axes $A_1$ and $A_r$. The deflection torque $T_d$ is imposed about axis $A_1$ which is horizontal and longitudinally aligned with the path of movement of the outside door 146; and the sagging torque $T_s$ is imposed about axis At which is horizontal and transverse of the path of movement of the outside door.

With reference to FIGS. 23 and 24, the effect of the deflection torque $T_d$ and sagging torque $T_s$ on the apparatus 142 is described. The weight $F_w$ of the outside door 146 imposes horizontal and vertical forces $F_h$ and $F_v$ on the ball bearings 240 and 242. at will be understood that the sagging torque $T_s$ increases as the outside door 146 moves outwardly into its extended positions. Because the plane of the outside door intersects the point of connection of the track 170 to the column 130 and is very close to the axis 133 of the column, the moment arm through which the force $F_w$ acts is relatively short and the deflection and sagging torques are maintained at a minimum.

Moreover, referring to FIGS. 24, the weight $F_w$ of the outside door 146 creates reactive forces $F_{v1}$ and $F_{v2}$ on the bearings 240 and 242. The track 170 and the carriage 200 are able to sustain these forces and maintain the carriage bar 220 in a horizontal attitude within the track as the outside door moves endwardly into extended positions. As above described, a set of ten upper bail bearings and a set of ten lower bail bearings are used in the preferred embodiment, but the cage 202 can be varied in length and the number of bearings changed if necessary to adjust the support for a particular application.

The track 170 (FIG. 24) is maintained in a horizontal position by its connection to the column 130 which is securely attached to the side wall 104 of the bathing facility 102 and supported by the bathtub 110. The column thus provides a fixed fulcrum for the cantilever track 170 which exerts an upward reactive force $F_f$ as indicated in FIG. 24. The strength and horizontal attitude of the cantilever track is enhanced by the rigidity of the column 130 and by the location of the track, the carriage bar 220 and the carriage 200 within the plane or an imaginary umbra of the column. This construction thereby minimizes the adverse effect of deflection and sagging torques $T_d$ and $T_s$ on this structure so that the size of the supporting apparatus can be made small enough to fit aesthetically within a traditional bathing environment.

OPERATION

Figure 25:
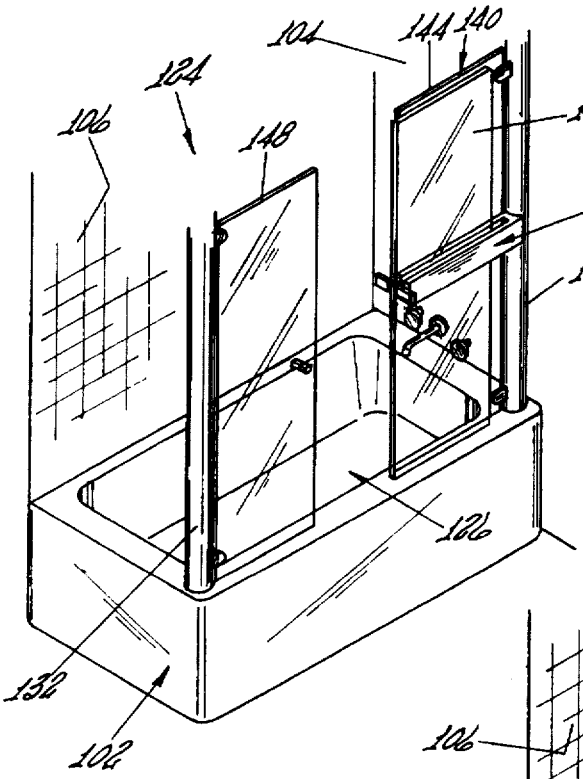
Figure 26:
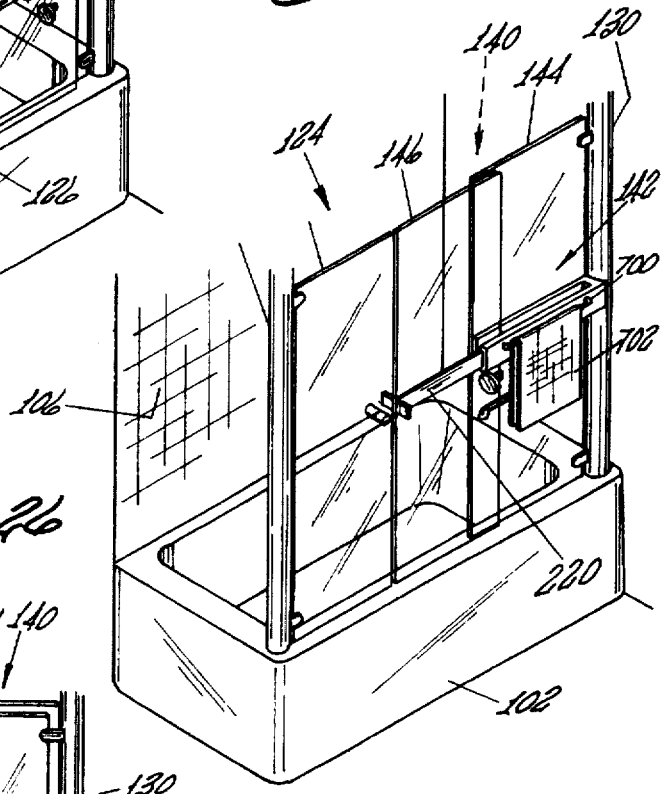

The operation of the subject enclosure 100 is best described by referring to the various positions of the enclosure, as illustrated in FIGS. 25 through 28. In FIGS. 25 and 26, all three shower doors 144, 146, and 148 are in the plane 128 of the entrance 126 to the bathing area 124 and essentially in alignment with each other, although the inside door 144 is slightly offset from the other two doors, which are in exact alignment. This position of the doors is referred to herein as the operating position. In the operating position, the lower edge segments 264, 314, and 568 of the three doors are closely spaced above the ledge 112. FIG. 26 shows the enclosure in completely closed position wherein the outside shower door 146 is fully extended with its outer edge segment 310 in contact with the outer edge segment 564 of the single door 148. The enclosure thus provides a splash barrier between the inside and outside of the bathing area 124 with the sealing mechanisms 475 precluding escape of water between the columns 130 and 132 and the walls 104. FIG. 25 still shows all doors in operating positions but shows the outside door fully retracted to open a passageway in the entrance 126 to enable ingress or egress to or from the bathing area 124. The cantilever supporting apparatus 142 allows translational movement of the outside shower door between its retracted and extended positions without deflection or sag of the door and thus without scraping or rubbing against the inside door or the ledge 112.

Figure 27:
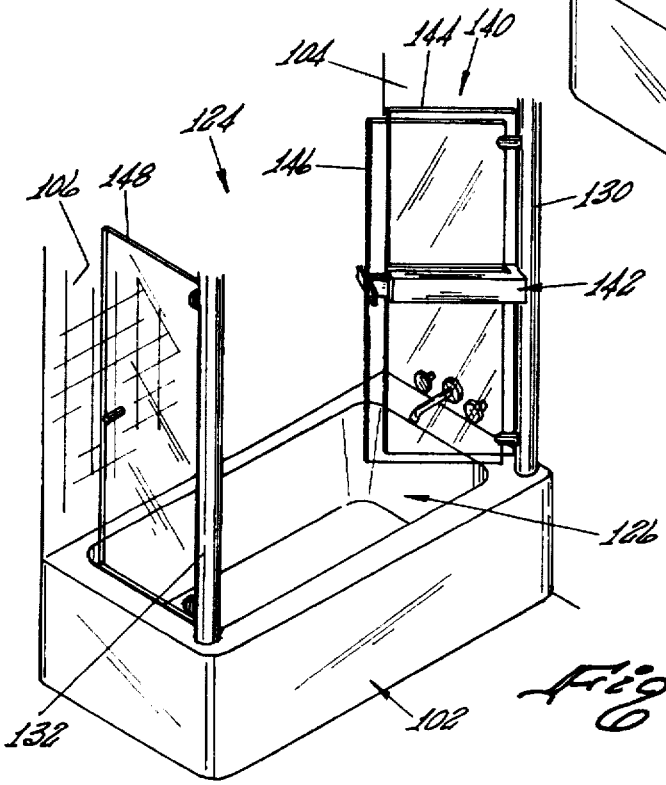

It is to be noted in FIG. 26 that a towel bar 700 may be attached to the outside of the web 180 of the cantilever track 170. The towel bar provides a convenient place to hang a towel 702 which partially obscures the cantilever track in the position of the doors shown in FIG. 26 and almost completely obscures the entire cantilever supporting apparatus 142 when the outside shower door 146 is in its retracted position, as shown in FIGS. 25, 27, and 28. For illustrative clarity, the towel bar 700 and the towel 702 have been shown only in FIG. 26, but it will be understood that they could be incorporated in the enclosure 100 as shown in all of the figures.

Entry or access to the bathing area 124 can be obtained in several ways. As described above, the outside sliding shower door 146 can be slid to the right, as shown in FIG. 25, until it is in complete overlapping relation to the inside shower door 144. Alternatively, the single shower door 148 alone can be pivoted inwardly as far as the side wall 104 or about ninety degrees, as shown in FIG. 27, or pivoted outwardly approximately ninety degrees, as shown at the left in FIG. 28. Such pivoting movement of the single shower door is allowed because of the rotational mounting of the auxiliary column 132. Engagement of the stop pin 440 (FIG. 18) with the stop pieces 424 in the top hinge assembly 136 limits movement of the single shower door in either of its extreme positions prior to its contact with the side wall 104 or other wall or structure in the outermost position. With the single door thusly retracted, access to the bathing area can be obtained.

Of course, both the single door 148 and the outside door 146 can be retracted to open up about one-half of the entrance 126, a position not shown. It is noted that such retraction of the single shower door is shown in FIGS. 27 and 28 and such retraction of the outside shower door is shown in FIG. 25, although retraction of both in one Fig. is not shown.

Access to the bathing area 124 can also be obtained by pivoting only the dual door assembly 140 either in or out, as shown in FIGS. 27 and 28 and leaving the single door 148 in operating position, as in FIGS. 25 and 26. When access is required only for bathing purposes, however, it is easier to enter the bathing area 124 by moving the outside shower door 146 to the right or pivoting single shower door 148, as described above. If the dual doors are pivoted inwardly, however, they may be allowed to pivot a full ninety degrees depending on the location and type of shower head 116, tub filler 118 and faucets in the particular installation. During installation, the stop pieces 424 and pin 440 can be adjusted to limit pivotal movement in either direction to prevent contact of the doors with any adjacent hardware or structure.

When access to the bathing area 124 is required for bathing a small child or for cleaning the bathtub 110, all doors 144, 146, and 148 are pivoted in or out, as shown in FIGS. 27 and 28. The single shower door is pivoted either inwardly or outwardly, as described. With the double door assembly 140, the outside shower door 146 is first moved into its completely overlapping or retracted relation with the inside shower door 144, and these two doors are then either pivoted inwardly, as shown in FIG. 27, or outwardly as shown in FIG. 28. If the double doors are pivoted out, they are normally able to pivot a full ninety degrees and are so limited by the stop pin 440 and pieces 424. Pivoting in is the same as described above. With all of the shower doors pivoted either inwardly or outwardly, the entrance 126 to the bathing area 124 is completely free of all obstructions including the absence of a header as well as shower doors.

It is also to be observed that the ledge 112 is available for seating when the entrance 126 is either partially or completely open as shown in FIGS. 25, 27, and 28. This is to be contrasted with the standard angle- or channel-shaped tub rail, typically used with framed-in shower doors. Also, as the dual doors 140 or single shower door 148 move from their inwardly or outwardly pivoted positions into their operating positions, the detent pin 524 of the respective bottom hinge assembly 138 slides back into the notch 514 to align the dual doors and the single door perfectly in the entrance plane 128 in their operating positions.

Although the foregoing description and FIGS. 1 through 28 disclose a preferred configuration for the enclosure 100 of the subject invention, many other configurations are possible, several of which are illustrated in FIGS. 29 through 35(*a*).

In FIG. 29, a pair of double or dual door assemblies 140 are shown mounted on columns 130 in the vertical plane, as 128, of the entrance, as 126, of a bathing facility, as 102.

FIG. 30 illustrates the reverse of the configuration used in the preferred embodiment of FIGS. 1 through 28. As previously noted, the dual door assembly 140 is interchangeable from one side of an installation to the other merely by inverting the assembly and mounting it in the top and bottom hinge assemblies 136 and 138 on the opposite side of the entrance. Thus, in FIG. 30, a dual door assembly 140 is shown on the left of the bathing facility whereas a single door 148 is shown on the right.

FIGS. 31 and 31(*a*) are front elevation and top views of a still further configuration including a double door assembly 140 oriented in one plane on one side of the bathing facility, and a single door 148 oriented in a plane at right angles to the first plane on another side of the bathing facility.

FIGS. 32 and 32(*a*) are similar to FIGS. 31 and 31(*a*) in that the configuration is a right angular configuration, but here, a pair of dual door assemblies 140 is used at right angles to each other.

FIGS. 33 and 33(*a*) shows one dual door assembly 140 mounted on the left side of the entrance to a bathing facility similar to that of the configuration of FIGS. 29 or 30 but without a companion dual door assembly or single door 148.

FIG. 34 and 34(*a*) are similar to FIGS. 33 and 33(*a*) in that only a single shower door 148 is utilized on the left side of the bathing entrance 126.

FIGS. 35 and 35(*a*) show a configuration similar to that of FIGS. 31, 31(*a*), 32, and 32(*a*), except that here, only two single shower doors at right angles to each other are employed.

From the foregoing, it will be understood that the subject bathing enclosure supports shower doors of glass, or other material, in a headerless bathing facility in side-by-side spaced upstanding positions so that they can be moved relative to each other or together and into and out of closing, opening, and retracted positions. The absence of the header enhances the clean and open appearance of the bathing facility. The doors may also be frameless since frames are unnecessary for support with the present invention, but they may be used from a decorative standpoint if framed doors are preferred over the frameless doors. At the same time, the supporting apparatus maintains the shower doors in their spaced upstanding positions for the described movement without deflecting, sagging, tipping, tilting, weaving, or otherwise becoming misaligned and without rubbing or scraping against each other or adjacent surfaces of the bathing facility.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An apparatus for closing and opening the entryway to a bathing facility or other area having an entryway, comprising:

a column having upper and lower ends;

means for mounting the column in upstanding position in such an entryway;

area closure means having upper and lower edges; and supporting means attached to the column intermediate its upper and lower ends, extending outwardly from the column, and being also attached to the area closure means intermediate the upper and lower edges thereof for supporting the area closure means from the column.

2. The apparatus of claim 1 wherein the area closure means is a shower door having upper and lower edges; and wherein the supporting means supports the door on the column so that the plane of the door intersects the column.

3. An apparatus for supporting a door in the entrance to a bathing facility or other area, comprising:

a fulcrum;

means for mounting the fulcrum in the entrance to a bathing facility or other area;

a cantilever extending substantially horizontally from the fulcrum; and a door having upper and lower edges, being attached to the cantilever between said upper and lower edges so that the plane of the door intersects the fulcrum, and being thusly supported by the cantilever.

4. The apparatus of claim 3, wherein the cantilever extends transversely across the face of the shower door between its upper and lower ends and in spaced relation thereto and supports the shower door in upstanding position.

5. An apparatus for mounting a pair of doors on a supporting structure, comprising:

a column;

means on the column for attaching a door thereto;

means on the column for attaching the column to the supporting structure;

dual cantilevers secured to the column intermediate the ends thereof and extending radially therefrom in opposed spaced relation to each other; and means on each cantilever for attaching a door thereto.

6. An enclosure for a bathing or other area where there is an opening for enabling ingress and egress to and from the bathing or other area, comprising:

a fulcrum;

means for mounting the fulcrum in such an opening of a bathing or other area;

first and second cantilevers in space juxtaposed relation to each other having inner ends independently fixed to the fulcrum and outer ends spaced from the inner ends and adapted to extend outwardly in such opening; and first and second door panels respectively mounted on the first and second cantilevers in adjacent space upstanding positions thereby being adapted to be disposed in such an opening.

7. An enclosure for a bathing or other area where there is an opening for enabling ingress and egress to and from the bathing or other area, comprising:

first and second door panels having opposite faces; and means for cantilevering the first and second door panels independently of each other in upstanding positions and in laterally spaced, face-to-face relation in said opening and for moving at least one of the panels relative to the other panel to vary the degree of closure of the opening.

8. The enclosure of claim 7, wherein each of the panels is a flat sheet of material having a peripheral edge, and wherein the peripheral edge of each sheet is exposed along substantially the entire length thereof.

9. The enclosure of claim 8, wherein each panel is a frameless piece of glass.

10. The enclosure of claim 7, wherein said bathing area has opposed spaced walls on opposite sides of said opening, and wherein there is no header extending between the walls of the bathing area so that the opening provides unobstructed access to the bathing area except for the presence of the door panels in the opening.

11. The enclosure of claim 7, wherein the door panels are glass panels.

12. The enclosure of claim 11, wherein each glass door weighs from about 30 pounds to about 50 pounds.

13. The enclosure of claim 7, wherein means are provided for adjusting the attitude of one of the doors relative to the other door about an axis extending lengthwise of the path of movement of said at least one panel.

14. The enclosure of claim 7, wherein means are provided for adjusting the attitude of one of the doors relative to the other door about an axis extending transversely of the path of movement of said at least one panel.

15. The enclosure of claim 7, wherein means are provided for adjusting the attitude of one of the doors relative to the other door about an axis extending lengthwise of the path of movement of said at least one panel; and wherein means are provided for adjusting the attitude of one of the doors relative to the other door about an axis extending transversely of the path of movement of said at least one panel.

16. An integrated door assembly for bathing areas and other areas to be closed and opened, comprising:

a column having opposite ends;

a pair of cantilevers secured to the column intermediate said ends and extending radially therefrom in opposed spaced relation to each other;

a first door mounted on the column and on one of the cantilevers; and a second door mounted on the other cantilever for translational movement relative to first door.

17. The assembly of claim 16, wherein each door is supported by its respective cantilever independently of the other cantilever.

18. An enclosure for a shower in a structure having an opening disposed in a vertical plane for enabling ingress and egress to and from the shower, said opening having a perimeter, comprising:

first and second shower doors each having a predetermined height;

a column having a height at least about equal to the height of the doors;

means for supporting the column on the structure in upstanding position at the perimeter of and in the plane of the opening;

a first cantilever member secured to the column, extending substantially horizontally therefrom, and adapted to be positioned in the plane of the opening;

first means attaching the first shower door to the column and to the first cantilever member to mount the door in upstanding position in said plane so as partially to close the opening;

a second cantilever member secured to the column in juxtaposition to the first cantilever member and extending substantially horizontally therefrom in opposed spaced relation to said first member; and second means mounting the second shower door on the second cantilever member in opposed face-to-face spaced relation to the first door for movement along a predetermined path toward and away from the column and relative to the first door between positions of various degrees of overlap with the first door thereby to increase and decrease the degree of closure of said opening to the bathing area.

19. The enclosure of claim 18, wherein the structure has a horizontal support surface;

wherein the column has upper and lower ends; and wherein the column supporting means includes means whereby the lower end of the column bears downwardly on the support surface so that part of the load borne by the column is exerted as a vertical force bearing downwardly on the structure.

20. The enclosure of claim 18, wherein the second cantilever member is a track;

wherein the second mounting means includes an elongated flat carriage bar movably mounted in the track and extending lengthwise thereof in said vertical plane; and wherein the second shower door is supported on the carriage bar and disposed in said plane;

said second mounting means movably mounting the carriage bar on the track so that the door is movable into selected positions of closure of the opening.

21. The enclosure of claim 20, wherein the first cantilever member is a flat cantilever bar with its longitudinal dimension extending horizontally and its transverse dimension disposed vertically and being parallel to the carriage bar;

wherein the track is channel-shaped and has a pair of horizontal rails directed toward and spaced from the cantilever bar and interconnected by a vertically disposed web in spaced parallel relation to the cantilever bar on the opposite thereof from the carriage bar;

wherein a U-shaped bearing cage is complementarily fitted in the track and has flanges in opposed spaced relation to the rails and a web interposed the carriage bar and the web of the track;

wherein bearings are positioned in the cage and ride against the carriage bar and the rails; and wherein the second mounting means secures the second door to the carriage bar.

22. The enclosure of claim 20, wherein there are stop means on the track and the carriage bar limiting movement of the carriage bar on the track.

23. The enclosure of claim 18, wherein the column supporting means mounts the column for rotational movement on its axis thereby enabling the doors to pivot conjointly between an operating position in the plane of the opening and a retracted positions out of the opening.

24. The enclosure of claim 23, wherein there are stop means on the column and adapted for attachment to the structure for limiting retracting movement of the doors.

25. The enclosure of claim 23, wherein detent means are provided on the column and the column supporting means for locating the doors in said operating position.

26. The enclosure of claim 18, wherein the column supporting means is adapted to support the column in spaced relation to the structure; and wherein there is a seal engaging the column and adapted to engage the structure to bridge the space between the column and the structure.

27. The enclosure of claim 18, wherein means are provided for adjusting the attitude one of the doors relative to the other door about an axis extending lengthwise of said path.

28. The enclosure of claim 18, wherein means are provided for adjusting the attitude of both doors about an axis extending transversely of said path.

29. The enclosure of claim 18, wherein the first shower door is disposed inwardly of the first cantilever member relative to the shower;

wherein the second cantilever member is disposed outwardly of the first cantilever member; and wherein the second door is disposed between the first and second cantilever members.

30. The enclosure of claim 18, wherein there is a second column;

wherein means are provided for mounting the second column on the structure in upstanding position at the perimeter of and in the plane of the opening on the opposite side thereof from the first mentioned column;

wherein there is a third shower door; and wherein means are provided for mounting the third shower door on the second column so that it is positionable in the plane of the opening in alignment with one of the first and second doors when the latter are positioned in the opening.

31. The enclosure of claim 30, wherein the second column mounting means mounts the second column for rotational movement on its axis thereby enabling the third door to pivot between an operating position in the plane of the opening and a retracted positions out of the opening.

32. A enclosure for a bathing facility including a bathtub and a shower and situated between spaced upstanding walls that also define an entrance to the tub, said entrance being further defined by a vertical plane intersecting the walls and the outer ledge of the tub and being characterized in that there is no header extending between the walls above the tub, the closure comprising:

a tubular column having upper and lower ends and a longitudinal axis;

hinge assemblies attached to the upper and lower ends of the column;

means for securing the hinge assemblies to one of said walls of the bathing area so that the column is attached to said one wall and is supported in a substantially vertical position on the ledge and stands next to one of the side walls at one side of the entrance with the axis of the column in the plane of the entrance;

a flat inside cantilever bar having an inner end secured to the column midway between its upper and lower ends and extending perpendicularly outwardly therefrom, an outer end, an inboard surface disposed inwardly of the tub, and an outboard surface disposed outwardly of the tub;

an inside glass shower door having inboard and outboard surfaces and a frameless circumferential outer edge including inner, outer, upper and lower segments;

means connecting the inside door to the upper and lower ends of the column and to the cantilever bar with the outboard surface of the door against the inboard surface of the bar, the inner edge segment adjacent to the column and being substantially coterminous therewith, and the lower edge segment in adjacent spaced relation to the ledge;

the inside door having a width and the bar having a length which are approximately equal to each other;

a channel-shaped outside cantilever track having an inner end secured to the column midway between the upper and lower ends thereof and extending perpendicularly outwardly therefrom in opposed spaced relation to the cantilever bar, an open channel facing the bar, and an outer end, said channel having upper and lower rails interconnected by a central web, the rails having means providing elongated upper and lower grooves extending lengthwise of the track in opposed spaced relation to each other;

a U-shaped bearing cage received complementarily in the track and having upper and lower flanges in adjacent spaced relation to the upper and lower rails respectively and interconnected by a central web in adjacent spaced relation to the web of the track, the flanges of the cage having a plurality of upper and lower holes therein;

a carriage bar fitted in the bearing cage having upper and lower edges in opposed spaced relation to the upper and lower flanges of the cage, respectively, an inboard surface facing the cantilever bar and lying in a vertical plane longitudinally intersecting the column, and an outboard surface facing the web of the cage, the upper and lower edges of the carriage bar having elongated grooves in respectively opposed spaced relation to the upper and lower grooves of the rails, all of said upper and lower grooves and holes being aligned in a common vertical plane on the opposite side of the vertical plane of said axis from the plane of the inboard surface of the carriage bar;

upper and lower bearings received in the holes and riding in the respectively adjacent aligned upper and lower grooves;

an outside glass shower door having inboard and outboard surfaces and a frameless circumferential outer edge including inner, outer, upper and lower segments; and means connecting the outside shower door to the carriage bar with its outboard surface against the inboard surface of the carriage bar, its inboard surface in closely spaced relation to the outboard surface of the cantilever bar, the outer edge segment adjacent to the outer end of the track, and the lower edge segment in adjacent spaced relation to the ledge;

the outside door having a width and the track having a length which are approximately equal to each other.

33. The closure of claim 32, wherein the hinge assemblies include means for supporting the column for rotational movement on its axis for enabling movement of the cantilever bar and track and the attached doors between an operating position in the entrance and parallel to the plane thereof and retracted positions in angular relation to the operating position.

34. An enclosure for a headerless bathing facility having an opening defined by an imaginary plane separating the inside from the outside of the bathing facility and through which a user passes in entering and leaving the facility, comprising:

first and second panel support means;

means cantilevering the first and second panel support means independently of each other so that they extend horizontally in said plane of the opening;

first and second frameless door panels having opposite faces;

first means mounting the first panel in upright position on the first panel support means; and second means mounting the second panel on the second panel support means in upright position and in adjacent face-to-face spaced relation to the first panel for movement in a predetermined longitudinal path alongside of the first panel into various degrees of overlap with the first panel thereby to vary the degree of closure of the opening with the panels;

said opening being free of obstructions except for the panels and the support means.

35. The bathing facility of claim 34, wherein the cantilevering means mounts the panel support means and the panels for movement transversely of said longitudinal path into and out of said plane of the opening.

36. The enclosure of claim 35, wherein means are provided for limiting said transverse movement of the panels.

37. The enclosure of claim 34, wherein the first and second door panels have upper and lower edges; and wherein the second mounting means attaches its panel support means to its panel intermediate the upper and lower edges of its panel.

38. The enclosure of claim 34, wherein the bathing facility provides side walls defining said opening;

wherein the cantilevering means includes a column;

wherein means are provided for supporting the column in an upright position in said plane of the opening and adjacent to one of said side walls;

wherein each door panel has upper and lower edges and a height measured between said edges;

wherein the column has upper and lower ends and a length approximately equal to the height of the panels;

wherein the column supporting means is adapted to attach the upper and lower ends of the column to the bathing facility; and wherein the second panel support means is attached to the second panel between its upper and lower edges and to the column intermediate its upper and lower ends.

39. The enclosure of claim 38, wherein the column has a longitudinal axis, wherein the column supporting means supports the column so that it is rotatable on its axis thereby enabling pivotal movement of the panels.

40. The enclosure of claim 34, wherein the second panel support means is a channel-shaped track; and wherein the second mounting means includes bearing means supporting the second panel on the track for movement in said predetermined path.

41. The enclosure of claim 40, wherein the track has a pair of upper and lower rails interconnected by a web;

wherein the bearing means includes a U-shaped bearing cage complementarily fitted in the track having flanges in opposed spaced relation to the upper and lower rails of the track interconnecting the flanges of the cage and being in opposed relation to the web of the track;

wherein the second mounting means includes an elongated bar fitted in the cage, said bearing means also having upper and lower bearings in the upper and lower flanges of the cage, respectively, and riding against the bar and the rails of the track; and wherein the second mounting means secures the second panel to the bar.

42. The enclosure of claim 34, wherein means are provided for limiting movement of the second panel along said longitudinal path.

43. A door assembly for opening and closing an entryway in a building structure, comprising:

the first and second doors each having upper and lower edges and being positioned in spaced side-by-side relation to each other;

first and second, cantilever members supported independently of each other in substantially horizontal positions and each having an inner and an outer end;

the first cantilever member extending transversely of the first door and secured thereto between the upper and lower edges thereof;

the second cantilever member extending transversely of the second door in juxtaposed spaced substantially parallel relation to the first cantilever member; and a carriage bar telescopically mounted on the second cantilever member and being moveable inwardly and outwardly relative thereto between inner retracted and outer extended positions;

the second door being secured to the carriage bar between the upper and lower edges of the second door and being moveable with the carriage bar between a face-to-face relationship with the first door in said retracted position and an overlapping relationship to the first door in said extending position.

44. The door assembly of claim 43:

wherein the cantilevers are secured to the building structure adjacent to the upper and lower edges of the doors.

45. The door assembly of claim 43:

wherein the first door is supported on the building structure adjacent to the upper and lower edges of the first door.

46. The door assembly of claim 43:

wherein the cantilevers are secured to the building structure adjacent to the upper and lower edges of the doors; and wherein the first door is supported on the building structure adjacent to the upper and lower edges of the first door.

47. The door assembly of claim 43:

wherein the attitude of one of the doors is adjustable relative to the other door about an axis extending lengthwise of the path of movement of the second door.

48. The door assembly of claim 43:

wherein there are upper and lower door adjusting members supported by the second cantilever member and moveable inwardly and outwardly respectively toward and away from the second door so that the upper adjusting member moves inwardly it causes the upper edge of the second door to move toward the first door, so that when the lower adjusting member moves inwardly it causes the lower edge of the second door to move toward the first door, and so that when either adjusting member moves outwardly, it allows its respective upper or lower edge to move away from the first door.

49. The door assembly of claim 48:

wherein the adjusting members are screws.

50. The door assembly of claim 43:

wherein there is a third door; and wherein the third door is positioned in edge-to-edge relation and in substantially the same plane as the second door when all of the doors are in closed positions.

51. The door assembly of claim 43:

wherein there are third and fourth doors;

wherein there are third and fourth cantilevers; and wherein there is a second carriage bar mounted on the fourth cantilever member supporting the fourth door thereon in the same manner as the second door is supported on the second cantilever.

52. The door assembly of claim 51:

wherein the third and fourth doors are supported independently of the first and second doors so that in the closed position of the doors, the first and third doors are substantially coplanar and the second and fourth doors are substantially coplanar.

53. The door assembly of claim 51:

wherein the third and fourth doors are supported independently of the first and second doors so that in the closed position of the doors, the first and second doors are in angular relation to the third and fourth doors.

* * * * *